US007134398B2

(12) United States Patent
Fujihara

(10) Patent No.: US 7,134,398 B2
(45) Date of Patent: Nov. 14, 2006

(54) WIPER DEVICE

(75) Inventor: Shinya Fujihara, Nagoya (JP)

(73) Assignee: Brother Kogyo Babushiki Kaisha, Nagoya (JP)

( * ) Notice: Subject to any disclaimer, the term of this patent is extended or adjusted under 35 U.S.C. 154(b) by 0 days.

(21) Appl. No.: 11/387,867

(22) Filed: Mar. 24, 2006

(65) Prior Publication Data

US 2006/0213414 A1 Sep. 28, 2006

(30) Foreign Application Priority Data

Mar. 28, 2005 (JP) ..... 2005-092071
Sep. 26, 2005 (JP) ..... 2005-277645

(51) Int. Cl.
*D05B 65/06* (2006.01)
*D05B 29/12* (2006.01)

(52) U.S. Cl. ..... 112/286

(58) Field of Classification Search ..... 112/286, 112/236, 240, 253, 235, 287, 291–298
See application file for complete search history.

(56) References Cited

U.S. PATENT DOCUMENTS 1,630,754 A * 5/1927 McNulty ..... 112/136
4,352,333 A * 10/1982 Yamazawa ..... 112/291
4,550,672 A * 11/1985 Kastrup ..... 112/293
5,367,969 A * 11/1994 Nonaka ..... 112/295
5,655,470 A * 8/1997 Tajima et al. ..... 112/236

* cited by examiner

*Primary Examiner*—Ismael Izaguirre
(74) *Attorney, Agent, or Firm*—Oliff & Berridge, PLC

(57) ABSTRACT

The wiper device for a sewing machine having a wiper member swingable from the operating position to a non-operating position on an embroidery presser foot, in which a needle thread-end is retained by being clamped between a frictional-resistance applying member fixed to an underside of a thread engagement portion located on a distal end of the wiper member and an upper surface of a cloth presser pressing a workpiece cloth by a returning movement of the wiper member from an operating position in which the wiper member performs a thread wiping operation to a stand-by position.

17 Claims, 41 Drawing Sheets

WIPER DEVICE

CROSS-REFERENCE TO RELATED APPLICATIONS

This application is based upon and claims the benefit of priority from the prior Japanese Patent Application Nos. 2005-092071, filed on Mar. 28, 2005 and 2005-277645 filed on Sep. 26, 2005 the entire contents of which are incorporated herein by reference.

TECHNICAL FIELD

The present disclosure relates to a wiper device for a sewing machine; in particular to a wiper device provided with a wiper member that wipes a needle thread cut after completion of a sewing operation and retaining the needle thread end by cooperation of the wiper member and a cloth presser.

BACKGROUND

Conventional sewing machines capable of embroidery sewing have been used that is provided with a cloth pressing mechanism that drives a cloth pressing member for pressing a workpiece cloth upon embroidery sewing, a thread cutting device that cuts a needle thread-end connected with a sewing needle, and a wiper mechanism that wipes up the cut needle thread-end with a wiper member.

For example, a wiper device for a sewing machine disclosed in JP-Y-6-52782 (hereinafter referred to as patent document 1) has a wiper body rotatably supported by a sewing machine frame, a presser foot for pressing a workpiece cloth, a reciprocating unit operating conjunctively with the vertical movement of the presser foot, and a connection link that connects the upper end of the wiper body to the upper end of the reciprocating unit. The reciprocating unit includes a support bar loosely fitted to a penetration hole defined on the presser foot and having a locking body in the lower portion thereof larger than the penetration hole; and a spring body supported by the support bar so as to receive the support bar therethrough.

According to the above construction, upon completion of a sewing operation, when the reciprocating unit is elevated in conjunction with the elevation of the presser foot, the wiper body is moved toward the sewing needle via the connection link and wipes up the needle thread-end cut by the thread cutting unit of the sewing machine.

Furthermore, in a thread wiping device disclosed in JP-A-2003-103080 (hereinafter referred to as patent document 2), a thread cutting device that automatically cuts the needle thread and a bobbin thread is provided near the underside of a needle plate of a sewing machine bed. Also a thread wiping device that pulls up the needle thread connected to the sewing needle above the needle plate and pulling out the needle thread-end from the workpiece cloth after cutting the needle thread with a thread cutting device is provided in a sewing machine head above the sewing machine bed.

The thread wiping device includes a wiper having a hook on the distal end thereof so that the needle thread can be pulled out from the workpiece cloth, a wiper drive mechanism that drives the wiper, and a needle thread retaining equipment provided on the wiper and retaining needle thread-end.

According to the above construction, upon completion of a sewing operation, when the needle bar and the cloth presser are elevated, the wiper is activated by the wiper drive mechanism and pulls the needle thread-end cut by the thread cutting device by hooking the needle thread with the hook. Thereafter, the needle thread-end is retained by the needle thread retaining equipment.

The wiper device disclosed in the patent document 1, merely pulls out the needle thread-end cut by the thread cutting unit above the workpiece cloth by the wiper member and does not retain the wiped needle thread. Thus, the needle thread-end is prone to twist, consequently leading to failure or deformation of initial stitches of the subsequent sewing sequence, and other similar problems.

Also, the thread wiping device disclosed in patent document 2 wipes up the needle thread with the wiper and retains the needle thread-end with the needle thread retaining equipment. However, the wiper is driven by the wiper drive mechanism in synchronization with the thread cutting movement of a moving blade of the thread cutting device, leading to increased complexity, size and cost of the thread wiping device.

SUMMARY

Therefore an object of the present disclosure is to provide a wiper device for a sewing machine capable of reliably retaining a wiped needle thread-end with a simple mechanism.

The wiper device of the present disclosure is attached to an embroidery presser foot having a cloth presser through which a sewing needle is penetratable. The wiper device is provided with a wiper member wiping the needle thread-end above the workpiece cloth after cutting the needle thread extending from the eye of the sewing needle by a thread cutting unit. The needle thread-end is thereafter retained by the cooperation of the cloth presser and the wiper member.

According to the above construction, the needle thread-end is clamped by the cooperation of the cloth presser and a wiper member provided for performing a thread wiping operation. Thus, after cutting the needle thread and wiping the needle thread-end so as to pull out the same above the workpiece cloth, the needle thread-end is thereafter retained reliably. Therefore, initial stitches of the subsequent sewing sequence are properly formed, thereby improving the sewing quality. Furthermore, the simple construction of the wiper device renders the size and manufacturing cost reduction.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION OF THE PREFERRED EMBODIMENT

A first embodiment of the present invention will be described hereinafter with reference to FIGS. 1 to 17.

Figure 1:
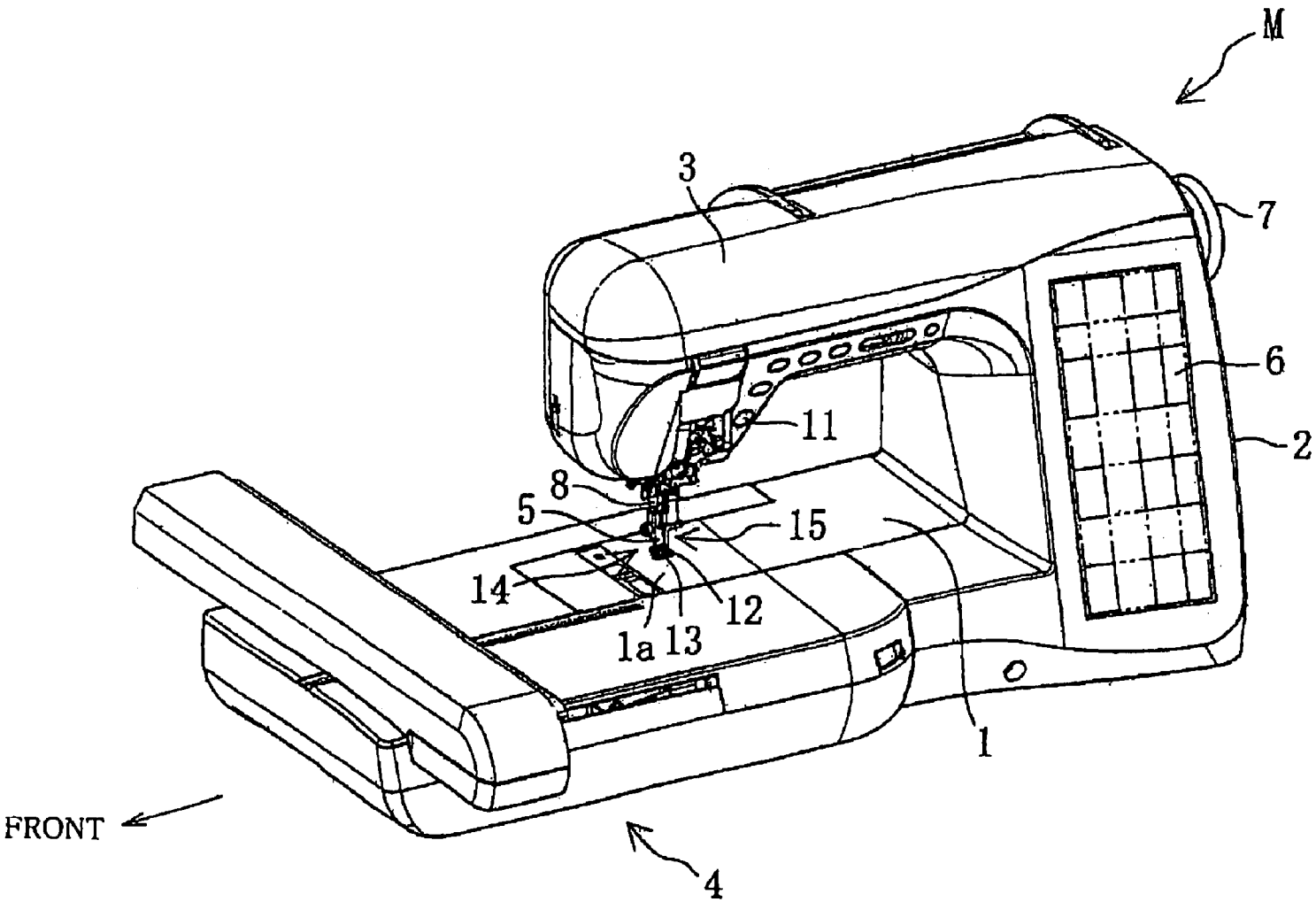
FIG. 1 is a perspective view of an embroidery sewing machine attached with a wiper device according to a first illustrative aspect of the present disclosure.
Figure 2:
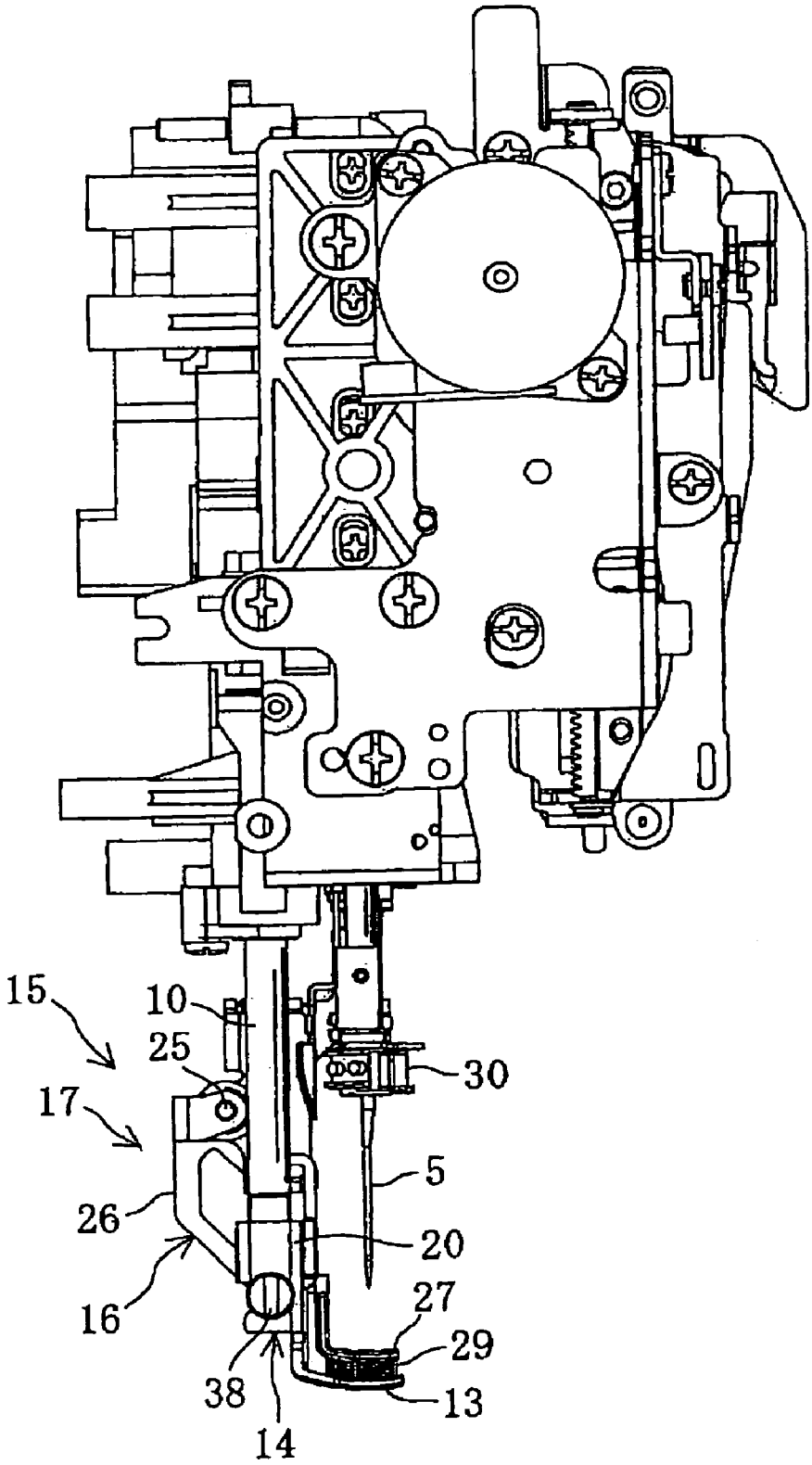
FIG. 2 is a left side view of the wiper device.

First, as shown in FIG. 1, a brief explanation will be given on a sewing machine M capable of embroidering.

The sewing machine M is similar to an ordinary house hold electronic sewing machine. The sewing machine M includes a bed 1, a foot 2 standing upright from the right end of the bed 1, and an arm 3 extending leftward from the upper end of the foot 2 and confronting the bed 1. An embroidery frame drive mechanism 4 enabling embroidery sewing using an embroidery frame (not shown) is detachably attached to the left side of the bed 1. The embroidery drive mechanism 4 drives the embroidery frame independently in an X direction (lateral direction) and a Y direction (longitudinal direction) respectively.

Provided under a needle plate 1*a* of the bed 1 are a feed dog vertically moving mechanism (not shown) vertically moving the feed dog and a feed dog longitudinally moving mechanism (not shown) longitudinally moving the feed dog, a hook mechanism (not shown) detachably accommodating a bobbin wound with a bobbin thread, and a thread cutting unit (not shown) for cutting a needle thread and a bobbin thread, and the like as in an ordinary sewing machine. A liquid crystal display 6 is provided on the front surface of the foot 2.

Provided in the arm 3 are a sewing machine main shaft (not shown) extending in the lateral direction and being rotated by a sewing machine motor, a hand pulley 7 capable of rotating the main shaft by a manual operation, a needle bar drive mechanism (not shown) vertically moving the needle bar 8 having a sewing needle 5 attached to the lower end thereof, a needle swing mechanism 9 swinging the needle bar 8 in the lateral direction perpendicular to a cloth feed direction, and a thread take-up drive mechanism (not shown) vertically moving the thread take-up in synchronization with the vertical movement of the needle bar 8. Furthermore, a reciprocating mechanism (not shown) reciprocating a presser bar 10 supported to a sewing machine frame reciprocably between an elevated position and a lowered position by a stepping motor fixed to the sewing machine frame are provided in the arm 3.

Also, a sewing start/stop switch 11 for starting/stopping a sewing operation is provided on the front surface of the arm 3. An embroidery presser foot 14 having a cloth presser 13 is mounted on the presser bar 10 provided in the head of the arm 3 and a penetration hole 12 through which a sewing needle 5 is vertically penetratable is defined in the cloth presser 13. A wiper device 15 that wipes the needle thread-end extending from an eye of the sewing needle 5 is provided on the embroidery presser foot 14. After cutting the needle thread by a thread cutting mechanism provided below the needle plate 1*a*, the wiper device 15 wipes the needle thread-end so as to pull the needle thread-end above the workpiece cloth. A later described support member 20, a support shaft 21, and a drive force input mechanism 22, and the like are provided on the embroidery presser foot 14 and the wiper device 15.

Next, the wiper device 15 will be described.

As shown in FIGS. 2 to 9, and 13, the wiper device 15 is provided with a wiper mechanism 17 including a wiper member 16, a wiper drive mechanism 18 driving the wiper mechanism 17 and rendering a thread wiping operation of the wiper member 16, and a switch mechanism 19 that switches the wiper member 16 between the operable state and the inoperable state in conjunction with the position of the needle bar 8.

Next, the wiper mechanism 17 and the wiper member 16 will be described based on FIGS. 2 to 5, and 13. The wiper mechanism 17 includes a wiper member 16 and a link mechanism 23.

The wiper member 16 is swingably supported about a horizontal pivot shaft 25 of the main body member 24 of a drive force input mechanism 22 provided on an embroidery presser foot 14. The horizontal pivot shaft 25 is disposed parallel to the needle swinging direction (lateral direction). The wiper member 16 includes a circumventing arm 26 and a thread engagement portion 27 integrally formed on the lower end of the circumventing arm 26.

The circumventing arm 26 is formed such to prevent the wiper member 16 from interfering with a needle fastening member 30 fixing the sewing needle 5 to the needle bar 8, when the wiper member 16 is upwardly swung to wipe the thread.

The thread engagement portion 27 provided on the distal end of the wiper member 16 is shaped substantially the same as the cloth presser 13 in plan view. A wide penetration hole 28 in a substantially oval form allowing a vertical penetration and a lateral swing of a sewing needle 5 therein is defined inside the thread engagement portion 27. In the present embodiment, the penetration hole 28 is shaped the same as the penetration hole 12 of the cloth presser 13. A later described frictional-resistance applying member 29 is fixed on the entire periphery of the thread engagement portion 27 underside.

A support member 20 is integrally formed on the cloth presser 13 attached to the presser bar 10. A support shaft 21 is vertically fixed to a pair of an upper support piece 20*a* and a lower support piece 20*b* of the support member 20.

The drive force input mechanism 22 includes the main body member 24 supported vertically movably to the support shaft 21 and a laterally swingable abutting member 31 provided on the upper end of the main body member 24. An abutting portion 31*a* is formed on the upper end of the abutting member 31.

A pair of an upper guided portion 24*a* and a lower guided portion 24*b* are formed on the main body member 24. The support shaft 21 is inserted vertically slidably to the lower guided portion 24*b* disposed between the pair of the upper support piece 20*a* and the lower support piece 20*b*. The support shaft 21 is inserted vertically slidably to the upper guided portion 24*a* disposed above the upper support piece 20*a*. An elastic member 32 composed of a compression spring is wound on a portion of the support shaft 21 located between the upper support piece 20*a* and the upper guided portion 24. The drive force input mechanism 22 is upwardly biased by the elastic member 32.

A pair of front-rear support pieces 24*c* is molded as to protrude to the right in front view on the upper end of the main body member 24, and a horizontal support shaft 33 longitudinally oriented in front view is fixed to the support pieces 24*c*. The abutting member 31 is supported swingably with respect to the horizontal support shaft 33 and unmovably in the shaft direction of the horizontal support shaft 33. Also, the abutting member 31 is biased counterclockwise in front view by the elasticity of a twisted coil spring 34 wound on the horizontal support shaft 33 and is supported by the main body member 24 in a locked disposition. The abutting member 31 is swingable at approximately 30° clockwise from the locked disposition.

Next, the link mechanism 23 will be described.

As shown in FIGS. 4, 5, 8 and 13, the link mechanism 23 includes a drive pin 35 implanted on a substantial vertical mid section of the support shaft 21 in a direction parallel to the needle swinging direction; a slit 36 defined in a vertically elongated manner in the main body member 24, a link arm 37 integrally molded with the wiper member 16 and a link slit 37*a* defined on the link arm 37. The drive pin 35 is slidably inserted to both the slit 36 and the link slit 37*a*.

Figure 4:
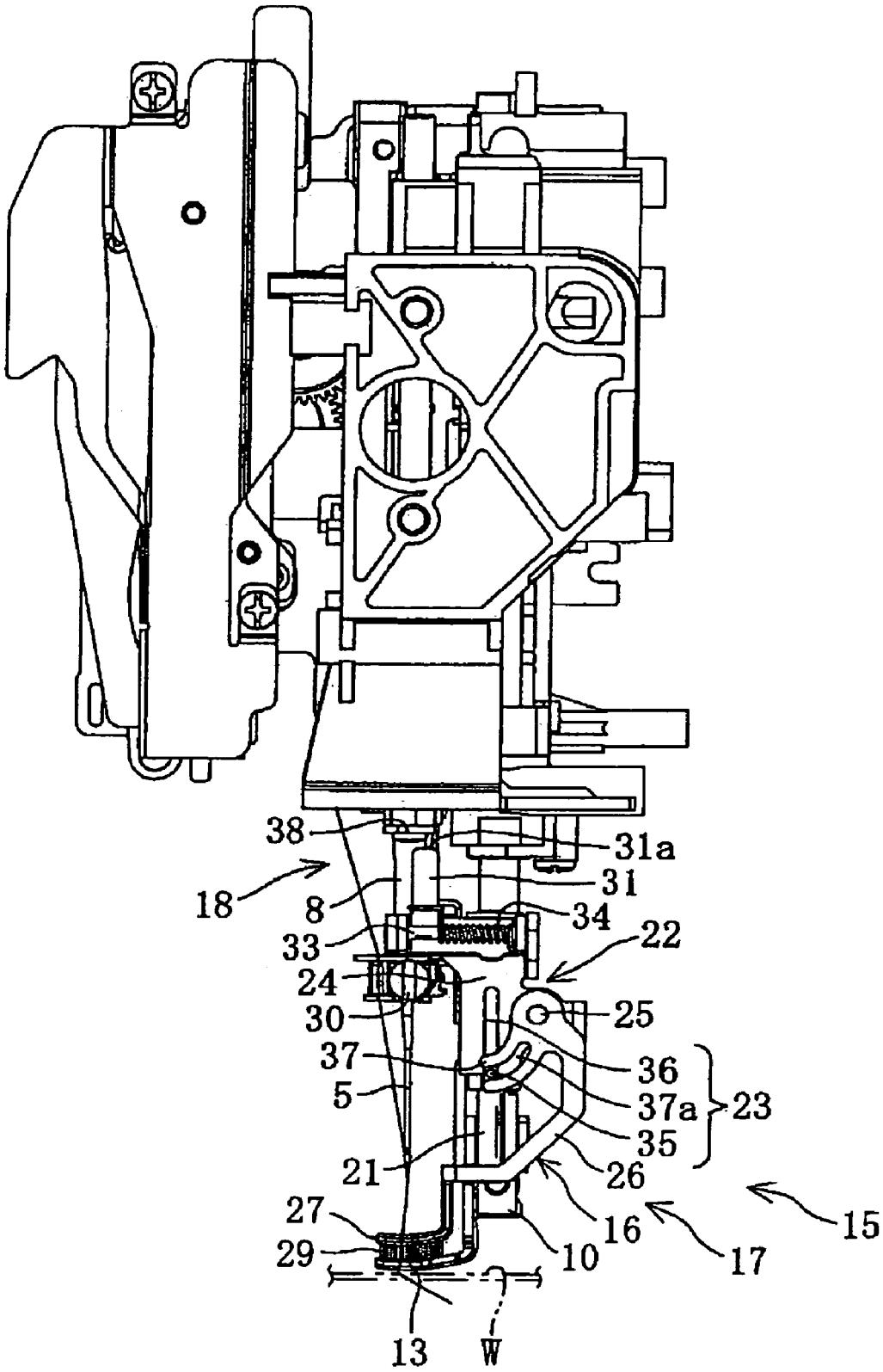
FIG. 4 is a right side view of the wiper device.
Figure 8:
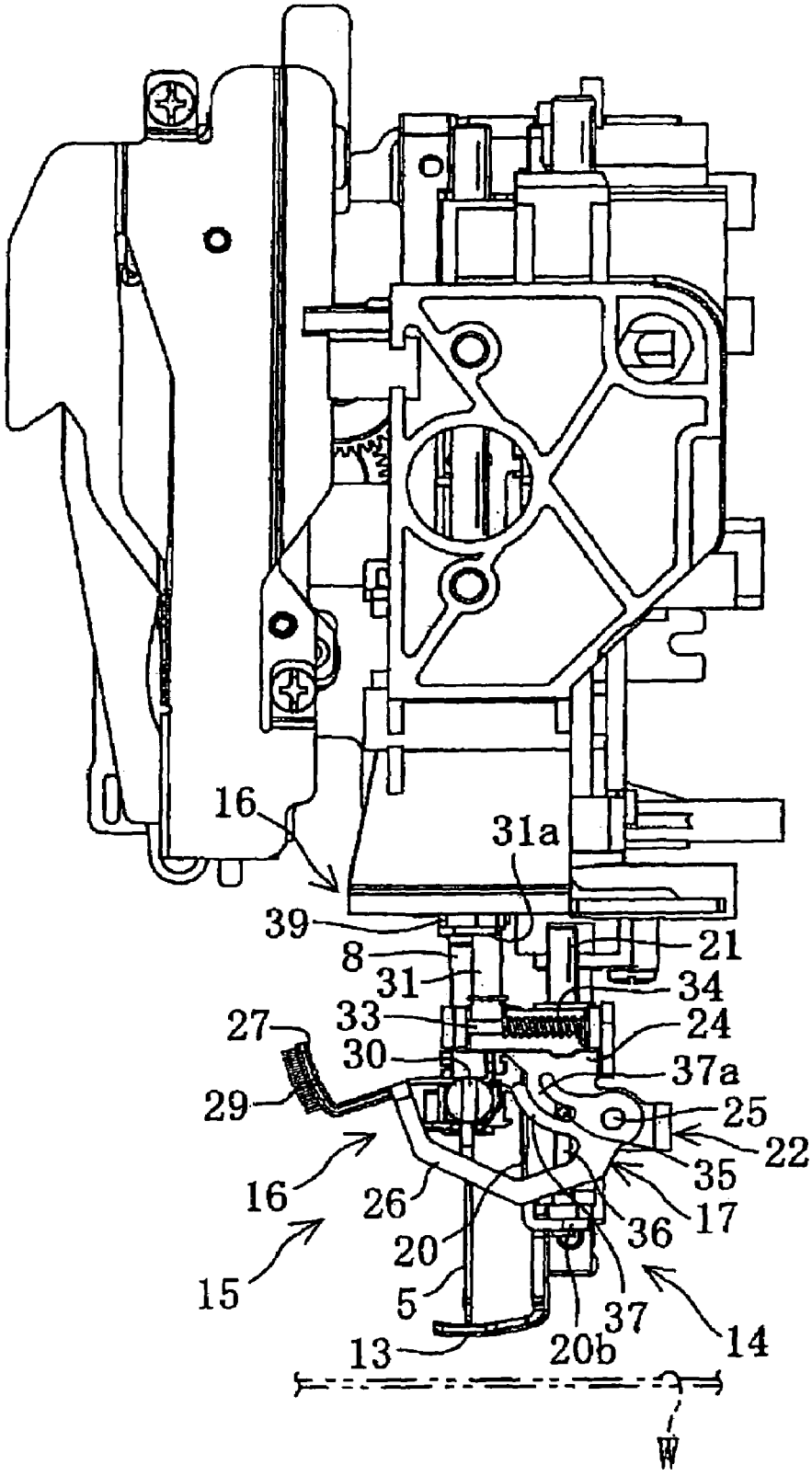
FIG. 8 is a right side view indicating the operating state of the wiper member.
Figure 9:
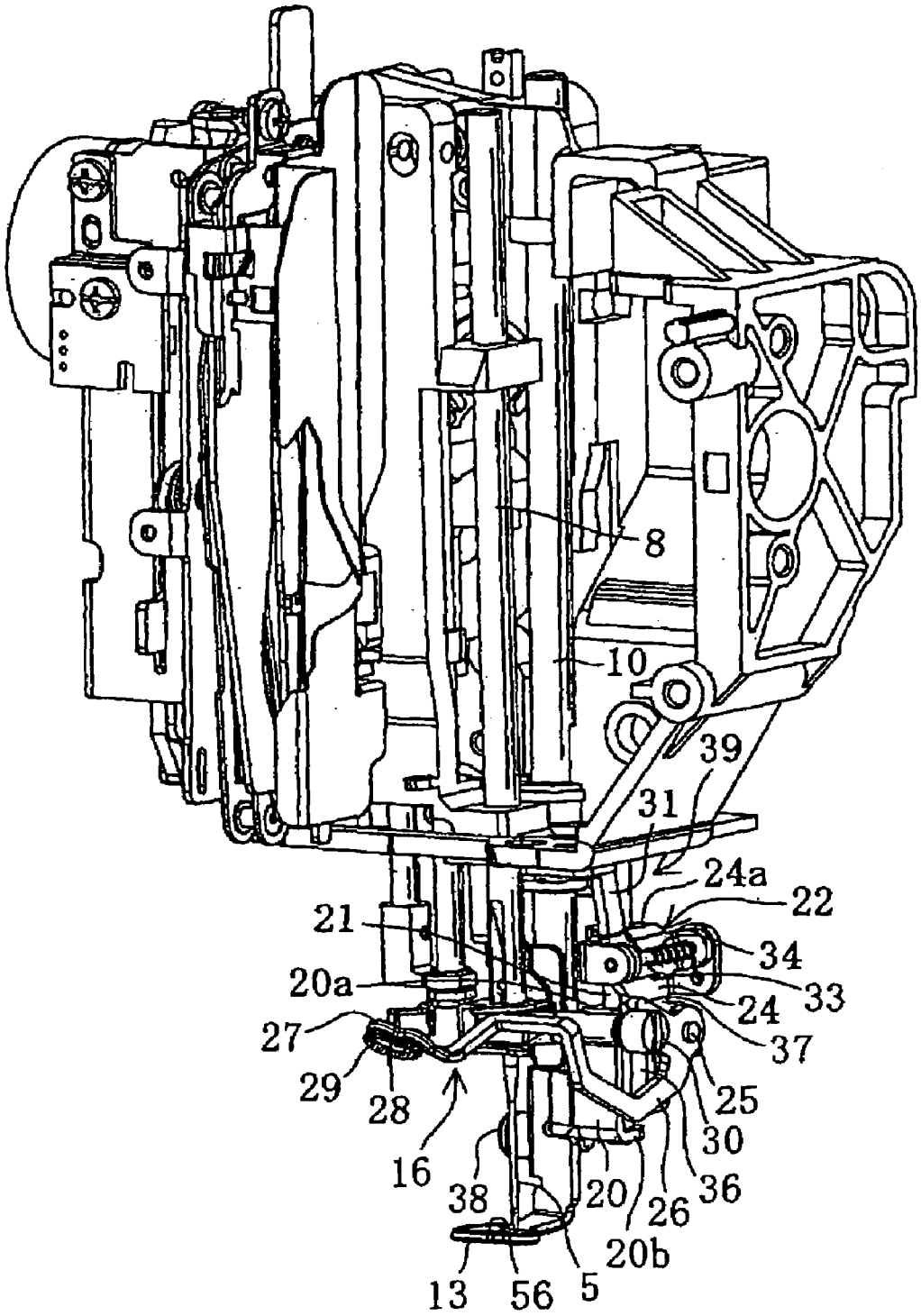
FIG. 9 is a perspective view indicating the operating view of the wiper member.
Figure 13:
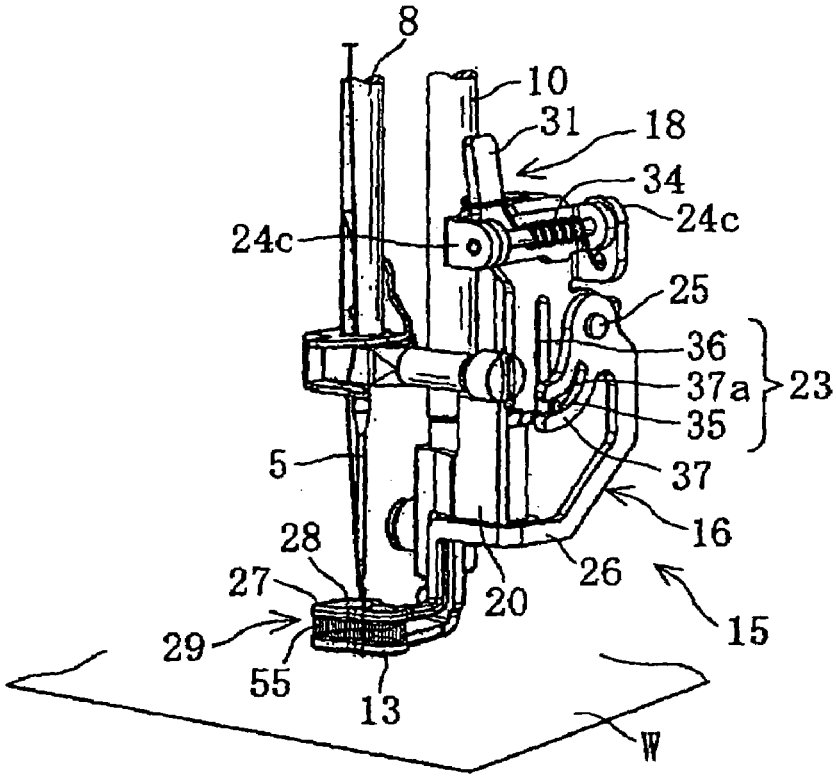
FIG. 13 is a perspective view indicating a stand-by state of the wiper member.
Figure 15:
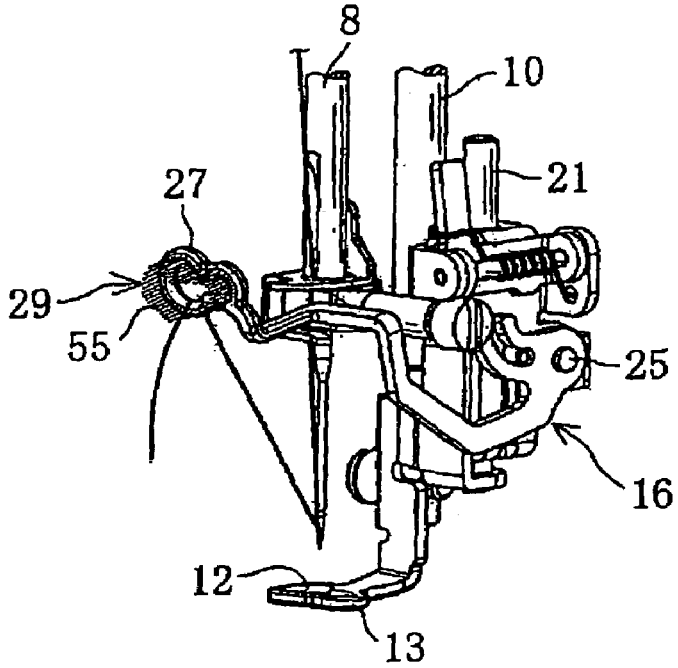
FIG. 15 is a perspective view illustrating the wiper member upon completion of the thread wiping operation.

When the main body member 24 is downwardly moved without moving the vertical position of the support member 20 mounted on the presser bar 10, the position of the horizontal support shaft 25 fixed to the main body member 24 is relatively lowered with respect to the drive pin 35. Thus, the link slit 37*a* of the wiper member 16 is displaced from a forwardly oriented lower oblique disposition as shown in FIGS. 4 and 13 to a forwardly oriented upper oblique disposition as shown in FIGS. 8 and 15. Consequently, as shown in FIGS. 4 and 13, the thread engagement portion 27 disposed above the cloth presser 13 and in close confrontation thereto (corresponding to a stand-by position of a non-operating wiper member) is displaced to a position in front of the needle fastening member 30 as shown in FIGS. 8 and 15.

Next a wiper drive mechanism 18 that drives the wiper member 16 by the vertical movement of the presser bar 10 will be described. The wiper drive mechanism 18 is driven by a reciprocating mechanism that reciprocates the presser bar 10. On the lower end of the presser bar 10, the lower end of the embroidery presser foot 14 is fixed thereto by a fastening screw 38. The support member 20 integrally formed with the embroidery presser foot 14 is also vertically moved by the vertical movement of the presser bar 10.

In case the abutting portion 31*a* of the abutting member 31 is in a position capable of abutting the needle bar base 39 described later, the support member 20 is elevated along with the elevation of the presser bar 10 and the abutting portion 31*a* abuts the needle bar base 39. When the abutting portion 31*a* abuts the needle bar base 39, the abutting portion 31*a* is thereafter locked in such position. In case the support member 20 is further elevated along with the presser bar 10, as described earlier, the position of the horizontal support shaft 25 fixed to the main body member 24 is moved relatively downward with respect to the drive pin 35. Thus, the wiper member 16, as shown in FIGS. 4 and 13, moves from the stand-by position in which the wiper member 16 does not operate, to the position in front of the needle fastening member 30 as shown in FIGS. 8 and 15. Then, the cut needle thread-end is wiped so as to be pulled to the upper surface of a workpiece cloth W while being retained inside the penetration hole 28 defined in the thread engagement portion 27 via the frictional-resistance applying member 29 fixed to the underside of the thread engagement portion 27.

Next, a switch mechanism 19 will be described hereinafter.

Figure 3:
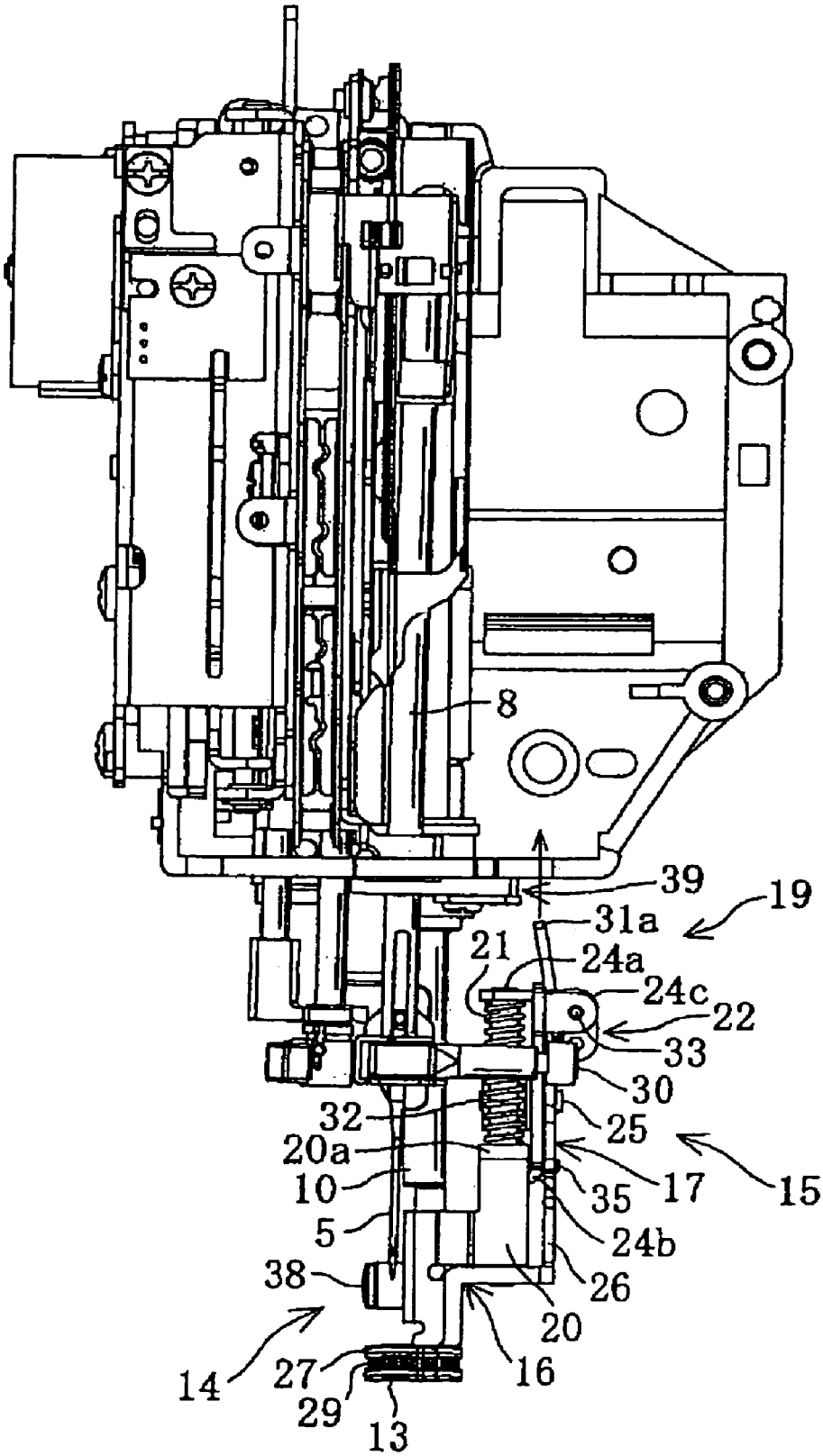
FIG. 3 is a front view of the wiper device.
Figure 5:
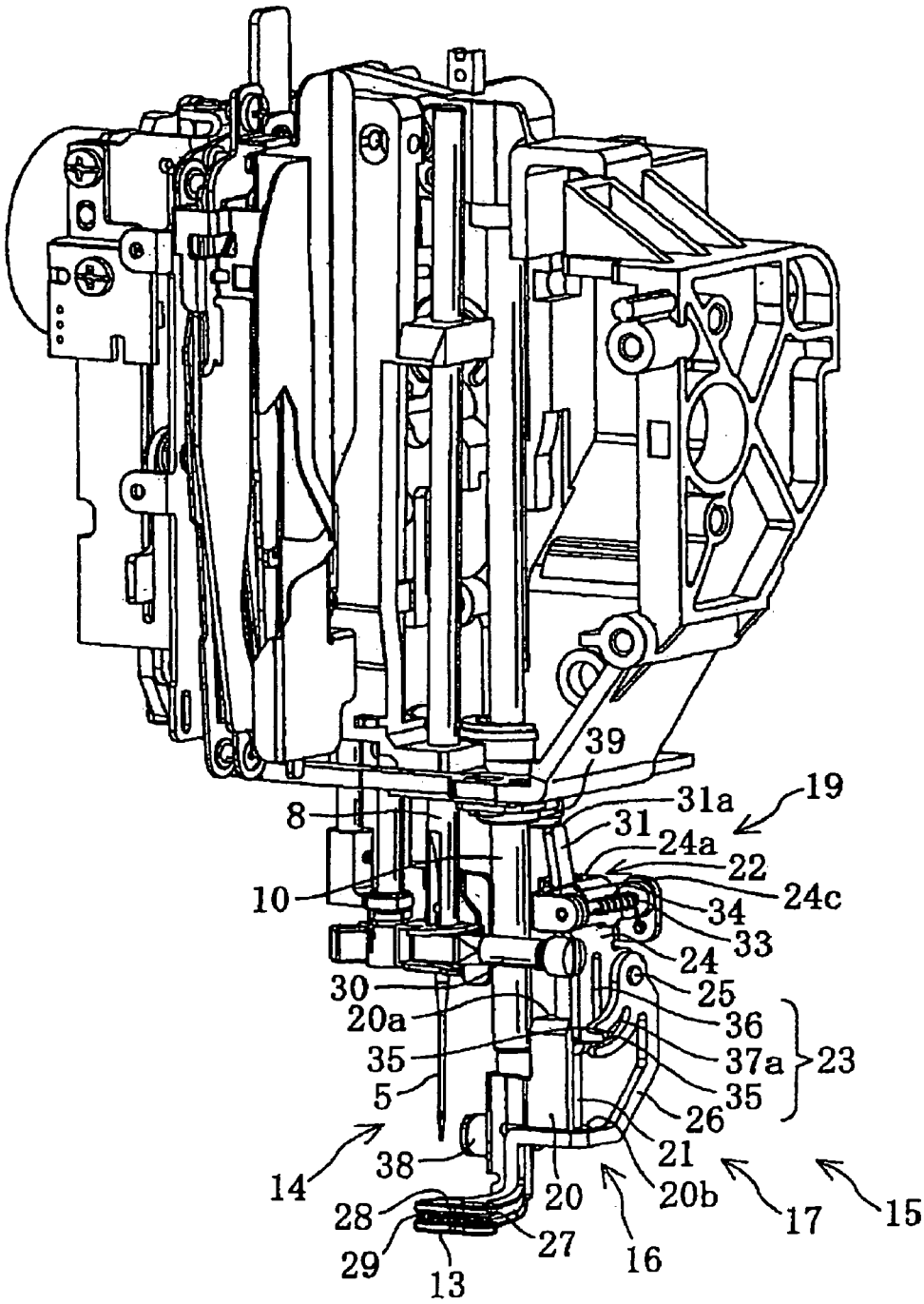
FIG. 5 is a perspective view of the wiper device.
Figure 6:
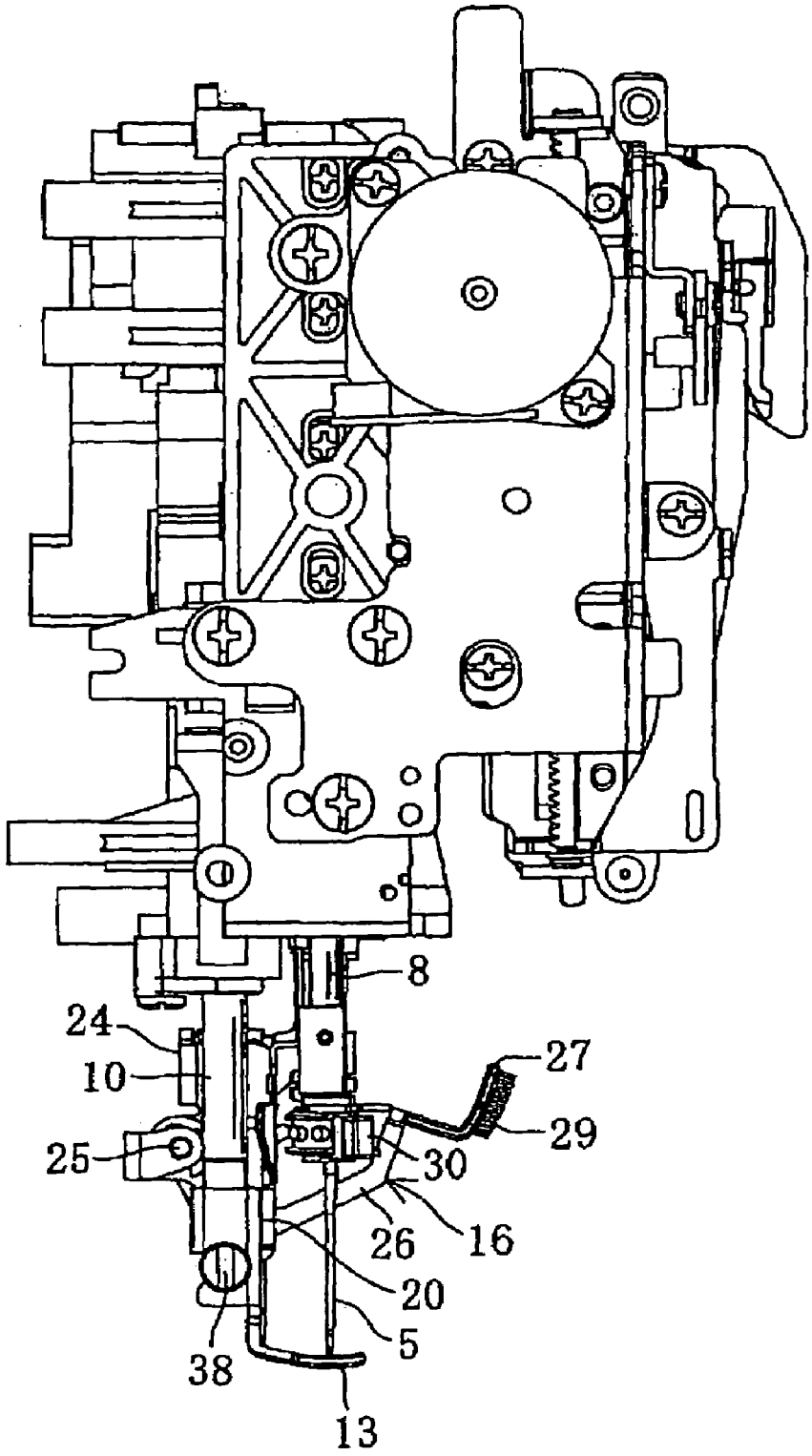
FIG. 6 is a left side view indicating an operating state of a wiper member.
Figure 7:
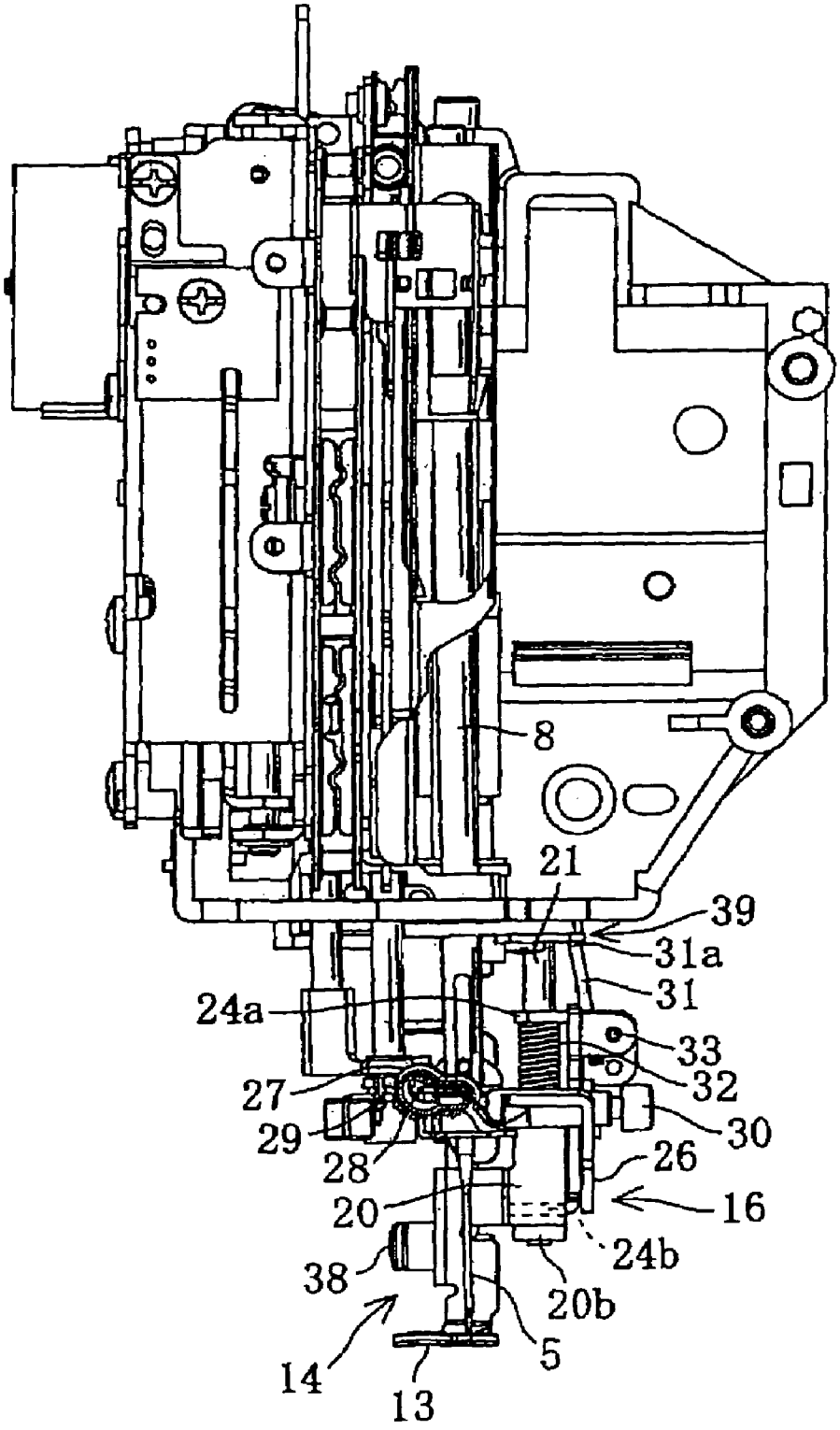
FIG. 7 is a front view of the operating state of the wiper member.

As shown in FIGS. 3 and 5, the switch mechanism 19 includes the needle swing mechanism 9 and the needle bar base 39 supporting the needle bar 8 in a vertically slidable manner.

A description will be given on the needle swing mechanism 9 that swings the needle bar 8.

Figure 10:
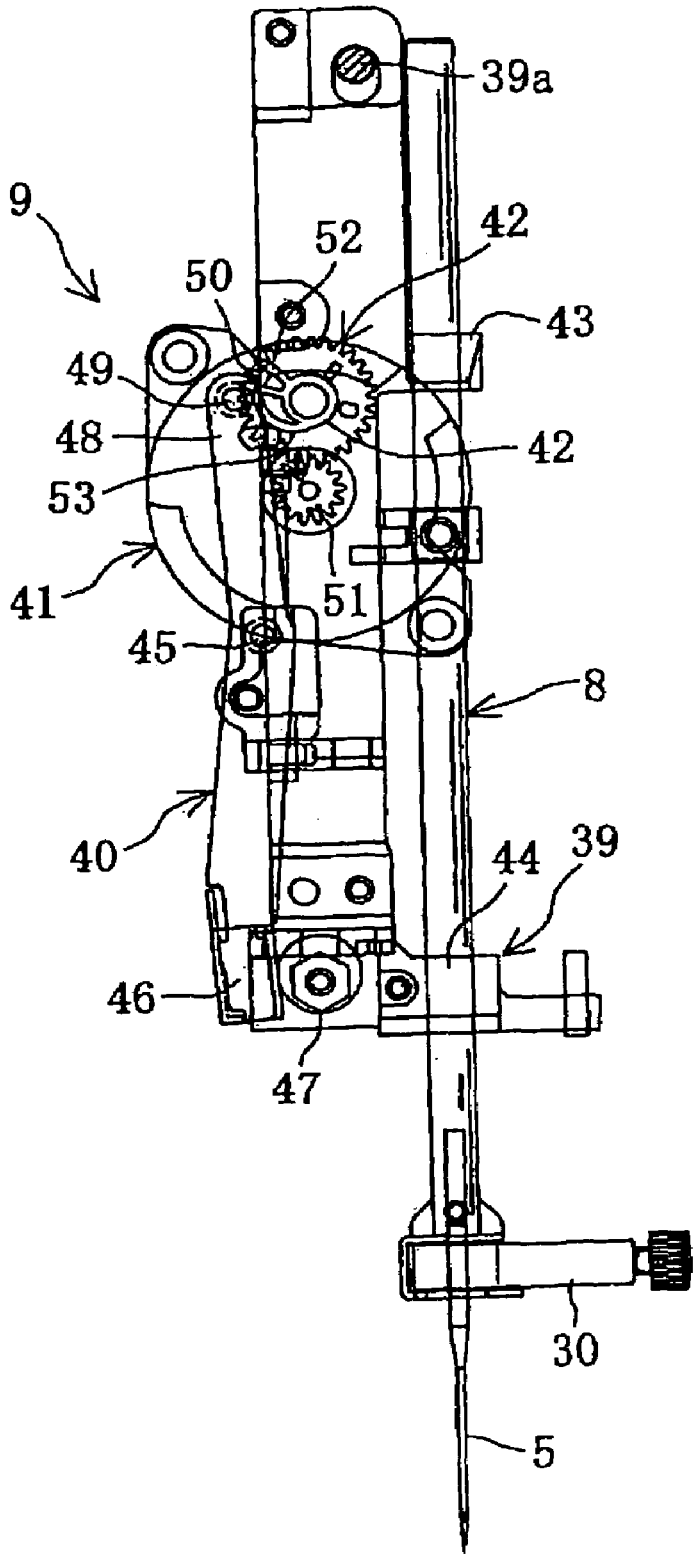
FIG. 10 is a front view of a needle swing mechanism.
Figure 11:
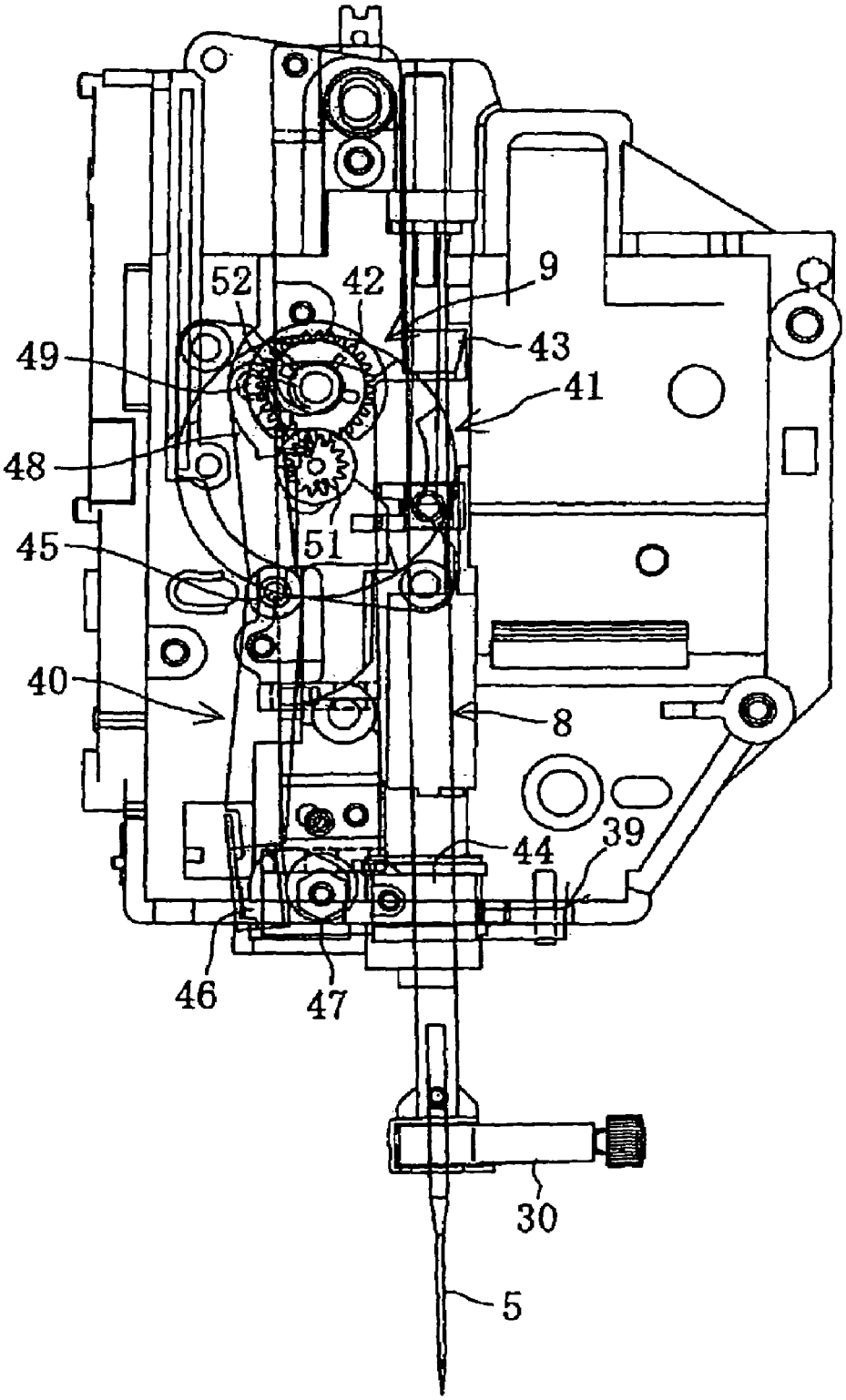
FIG. 11 is a front view of the needle swing mechanism wherein a needle bar is swung to the right.
Figure 12:
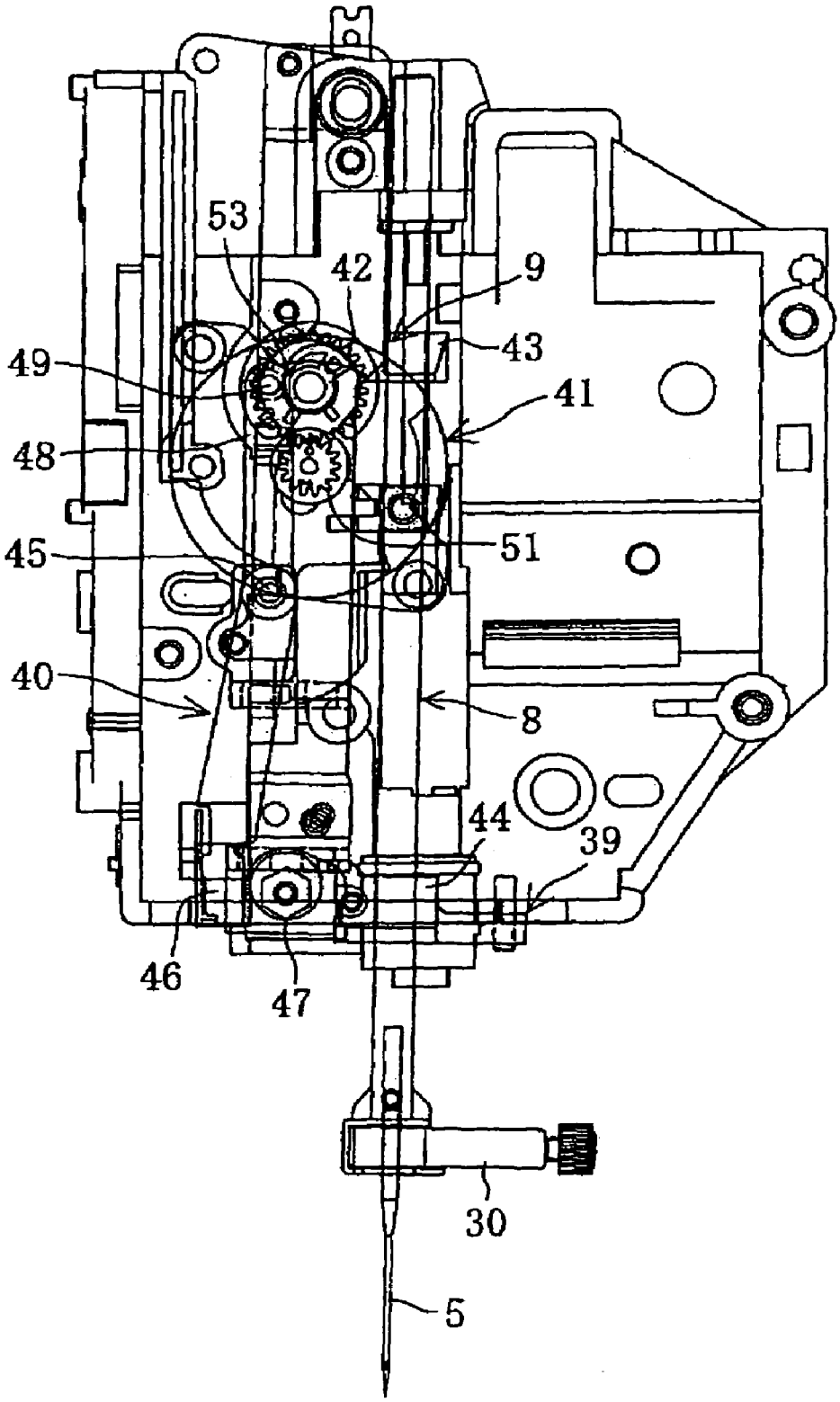
FIG. 12 is a front view of the needle swing mechanism wherein the needle bar is swung to the left.

As shown in FIGS. 10 to 12, the needle swing mechanism 9 includes the needle bar base 39, a swing lever 40, a stepping motor 41, and a swing cam 42, and the like.

As shown in FIG. 10, the needle bar base 39 is in a vertically extending form substantially parallel to the needle bar 8 and is arranged near the left side of the needle bar 8. The upper end of the needle bar 6 is swingably supported to a sewing machine frame by a support shaft 39*a*. The needle bar base 39 has an upper pivotal portion 43 and a lower pivotal portion 44 vertically movably supporting the needle bar 8. Therefore, when the needle bar base 39 is swung in the lateral direction, the needle bar 8 is swung in the lateral direction as well.

The swing lever 40 is in a vertically extending form substantially parallel to the needle bar base 39, and the substantial vertical mid section thereof is pivotally supported swingably with respect to a pivot pin 45 supported by the sewing machine frame. A lower end 46 of the swing lever 40 abuts a cam body 47 fixed to the lower end of the needle bar base 39 and an upper end 48 of the swing lever 40 has a pin 49 fixed thereto that abuts a cam surface 50 of the swing cam 42 that laterally swings the needle bar base 39. The lower end of the needle bar base 39 is leftwardly biased by a coil spring not shown such to retain the aforementioned abutments respectively.

The swing cam 42 is rotatably supported by the sewing machine frame and is driven by the stepping motor 41 fixed to the sewing machine frame. A gear in mesh engagement with a drive gear 51 of the stepping motor 41 is formed on the outer periphery of the swing cam 42. The cam surface 50 formed as a continuation of a large-radius cam surface 52 distanced away from the rotary shaft center of the swing cam 42 and a small-radius cam surface 53 in close distance with the rotary shaft center of the swing cam 42 are formed on the swing cam 42.

As shown in FIG. 11, the swing cam 42 is rotated by the rotation of the stepping motor 41, and when the pin 49 contacts the large-radius cam surface 52 distanced away from the rotary shaft center of the swing cam 42, the upper end 48 of the swing lever 40 is moved to the left. Then, since the lower end 46 of the swing lever 40 moves to the right via the support pin 45, the needle bar base 39 also moves to the right.

As shown in FIG. 12, the swing cam 42 is rotated by the rotation of the stepping motor 41 and when the pin 49 contacts the small-radius cam surface 53 in close distance with the rotary shaft center of the swing cam 42, the upper end 48 of the swing lever 40 moves to the right. Then, since the lower end 46 of the swing lever moves to the left via the pivot pin 45, the needle bar base 39 also moves to the left.

That is, when the lower end 46 of the swing lever 40 moves to the right (refer to FIG. 11) by the needle swing mechanism 9, the needle bar base 39 moves to a position in which the abutting member 31 and the abutting portion 31*a* can be abutted thereto. At this point, when the embroidery presser foot 14 and the support member 20 are elevated by the elevation of the presser bar 10, the abutting portion 31*a* abuts the needle bar base 39 and activates the wiper member 16.

On the other hand, when the lower end 46 of the swing lever 40 is moved to the left (refer to FIG. 12), the needle bar base 39 is moved to a retracted position incapable of abutting the abutting portion 31*a*. Therefore, even if the support member 20 is elevated along with the embroidery presser foot 14 by the elevation of the presser bar 10, the abutting portion 31*a* does not abut the needle bar base 39 and is merely positioned in the right side of the needle bar base 39. Hence the wiper member 16 is not activated.

Next, the frictional-resistance applying member 29 provided on the thread engagement portion 27 of the wiper member 16 will be described hereinafter.

As shown in FIGS. 2 to 9, 13 and 14, the frictional-resistance applying member 29 is constructed by a pile member 55 fixed on the entire underside of the thread engagement portion 27. The pile member 55, being a short-fluff fiber (e.g. cotton) implanted in even density on an underside of a base cloth, applies frictional resistance on the needle thread-end retained by the thread engagement portion 27. In case the thread engagement portion 27 is in the position above the cloth presser 13 of the embroidery presser foot 14, and in close confrontation thereto, distal end portions of the fluff of the pile member 55 contact the upper surface of the cloth presser 13. Thus, the needle thread-end by is retained by the cooperation of the thread engagement portion 27 and the cloth presser 13.

An operation of the wiper device 15 will be described hereinafter with reference to FIGS. 13 to 17.

The needle thread-end cut by the thread cutting mechanism not shown provided on the bed 1 after completion of a sewing operation is illustrated in FIG. 13.

In such state, when the embroidery presser foot 14 is elevated by elevating the presser bar 10 after moving the needle bar 8 to the right by the needle swing mechanism 9, the abutting portion 31*a* abuts the needle bar base 39. Then, as shown in FIGS. 14 and 15, the wiper member 16 is rotated, performing the thread wiping operation, and pulls the cut needle thread-end to the upper side of the workpiece cloth W.

Figure 14:
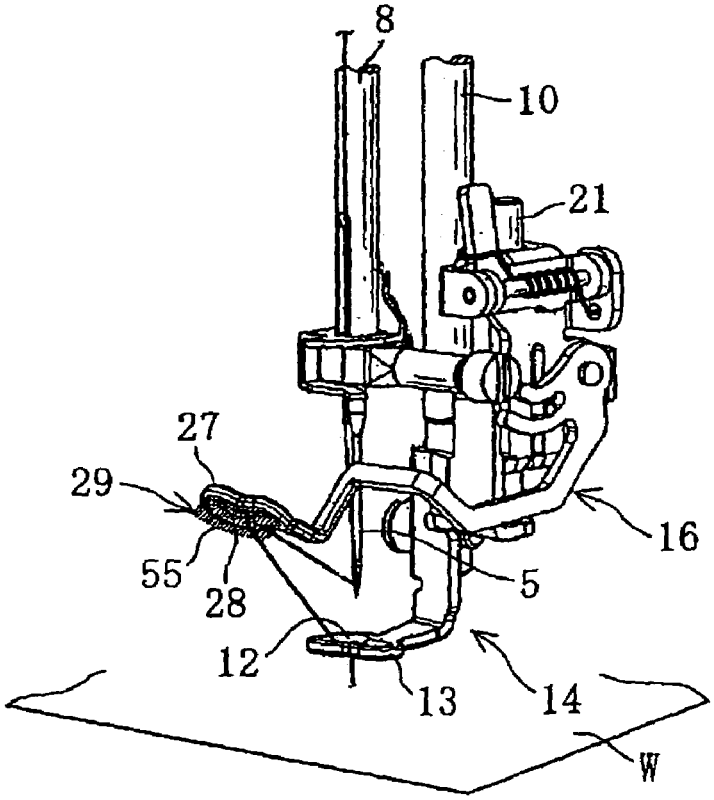
FIG. 14 is a perspective view illustrating the wiper member performing a thread wiping operation.

As shown in FIG. 14, when the needle thread-end is pulled up by the wiper member 16, the needle thread-end contacts the fluff of the pile member 55 and frictional resistance is applied thereto. Therefore, even in case the tension applied on the needle thread-end is released at the moment the needle thread-end is removed from the workpiece cloth W and the needle thread-end is subsequently loosened, the needle thread-end is reliably locked to the penetration hole 28 of the thread engagement portion 27 without falling out by the frictional resistance.

Figure 16:
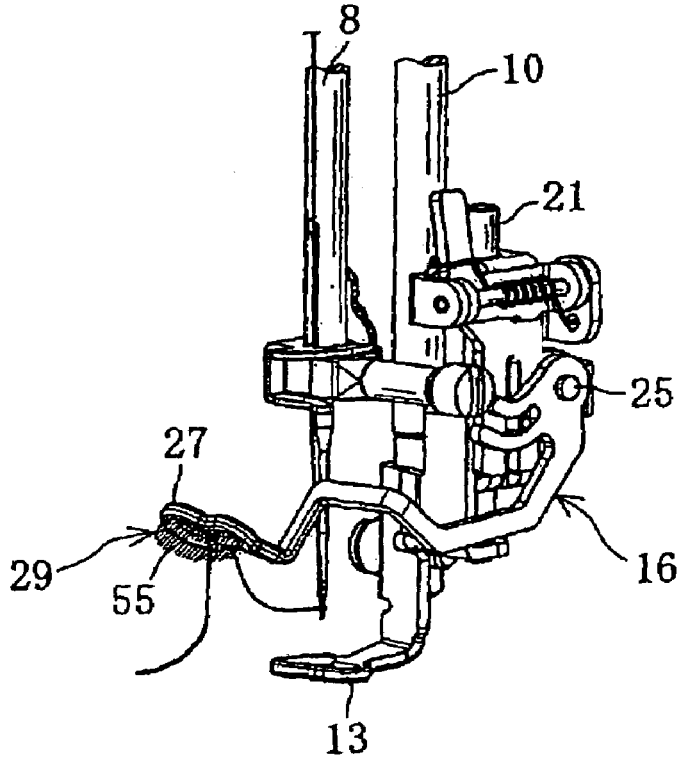
FIG. 16 is a perspective view illustrating the wiper member performing a returning movement to the stand-by position.
Figure 17:
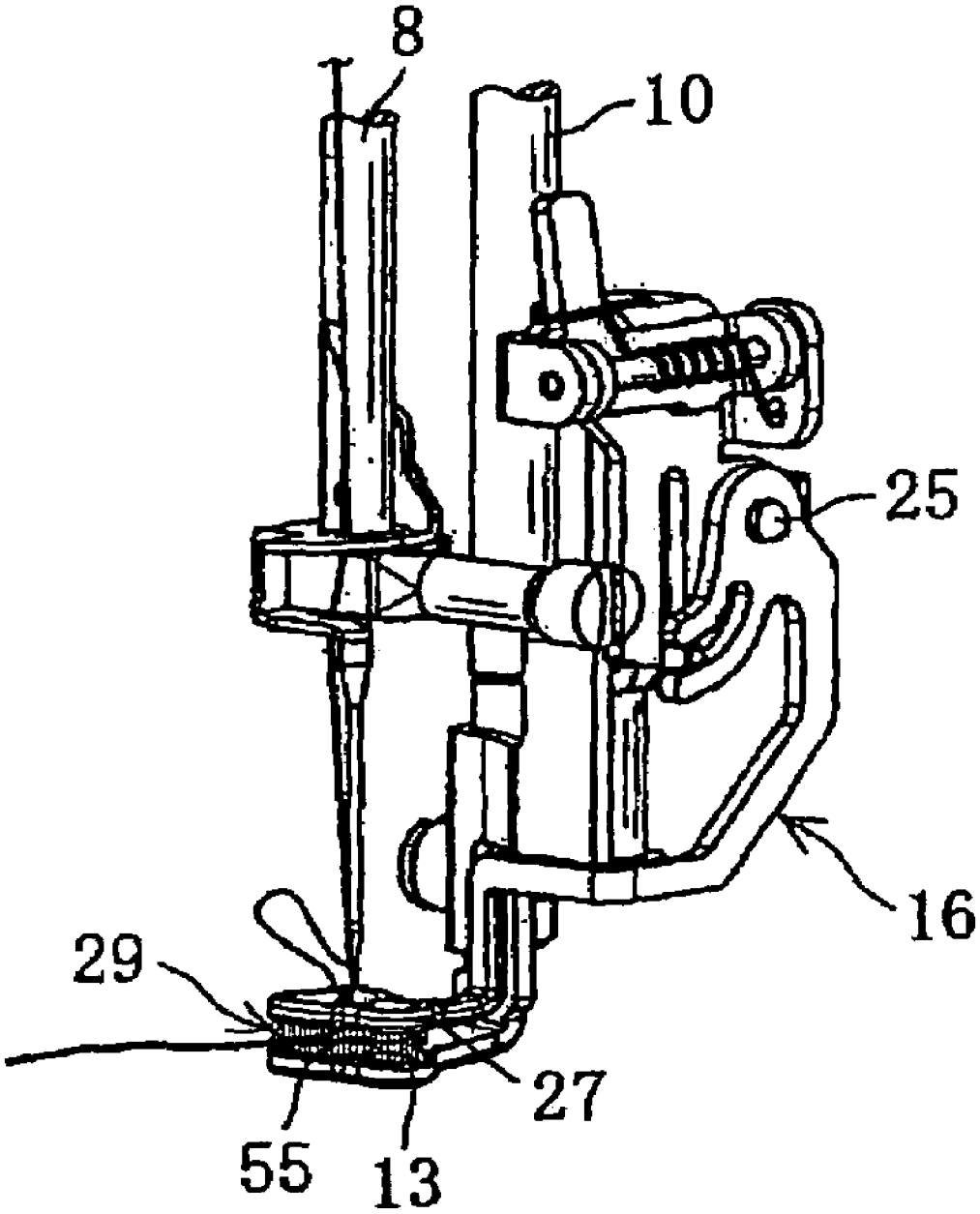
FIG. 17 is a perspective view illustrating the wiper member returned to the stand-by position.

Next, when the presser bar 10 is lowered, as shown in FIG. 16, the wiper member 16 is lowered with the needle thread-end locked to the thread engagement portion 27. Thereafter, as shown in FIG. 17, when the wiper member 16 is further lowered and returned to the stand-by position, the needle thread-end is retained by being clamped between the distal ends of the fluff of the pile member 55 and the upper surface of the cloth presser 13. Thus, the needle thread-end is retained by the returning movement of the wiper member 16 from the operating position to the stand-by position.

Next, the operation and effect of the wiper device 15 as described above will be explained hereinafter.

The wiper device 15 includes a wiper member 16 performing the thread wiping operation and retaining the needle thread-end cut by the thread cutting mechanism by the cooperation of the cloth presser 13 and the thread engagement portion 27 of the wiper member 16. Thus, the initial stitches of the subsequent sewing sequence are properly formed, improving the sewing quality. Furthermore, the simple construction of the wiper device enables size and manufacturing cost reduction.

Also, since frictional resistance is applied on the needle thread-end by the pile member 55 provided on the underside of the thread engagement portion 27, the needle thread-end can be prevented from falling off the thread engagement portion 27 during the thread wiping operation. Also, since the needle thread-end is retained by being clamped between the frictional-resistance applying member 29 and the upper surface of the cloth presser 13, the needle thread-end retention is rendered by a compact construction.

The wiper member 16 is provided with the thread engagement portion 27 that clamps the needle thread-end with the cloth presser 13. Since the thread engagement portion 27 is provided with the penetration hole 28 through which the sewing needle 5 is penetratable, the needle thread-end is clamped by being inserted to the penetration hole 28, thereby reliably retaining the needle thread-end.

Examples of partial modifications of the above described embodiment will be explained hereinafter. In the above embodiment, the frictional-resistance applying member 29 is provided on the entire underside of the thread engagement portion 27. Alternatively, the frictional-resistance applying member 29 may be provided on a part of the front portion of the thread engagement portion 27 underside in which the needle thread-end contacts the thread engagement portion 27. Also, the frictional-resistance applying member 29 may be provided not only on the underside of the thread engagement portion 27, but also on the upper surface of the cloth presser 13. As another alternative, the frictional-resistance applying member 29 may be provided only on the upper surface of the cloth presser 13.

The above embodiment adopts but does not limit to the use of the pile member 55 as the frictional-resistance applying member 29. Alternatively, a felt, sponge, urethane foam, rubber, mating surface fastener, or the like may be used.

Furthermore, the shape of the thread engagement portion 27 is substantially the same as the cloth presser 13 in plan view; however, different shapes may be adopted.

Next, a second embodiment of the present invention will be described with reference to FIGS. 18 to 42.

Figure 18:
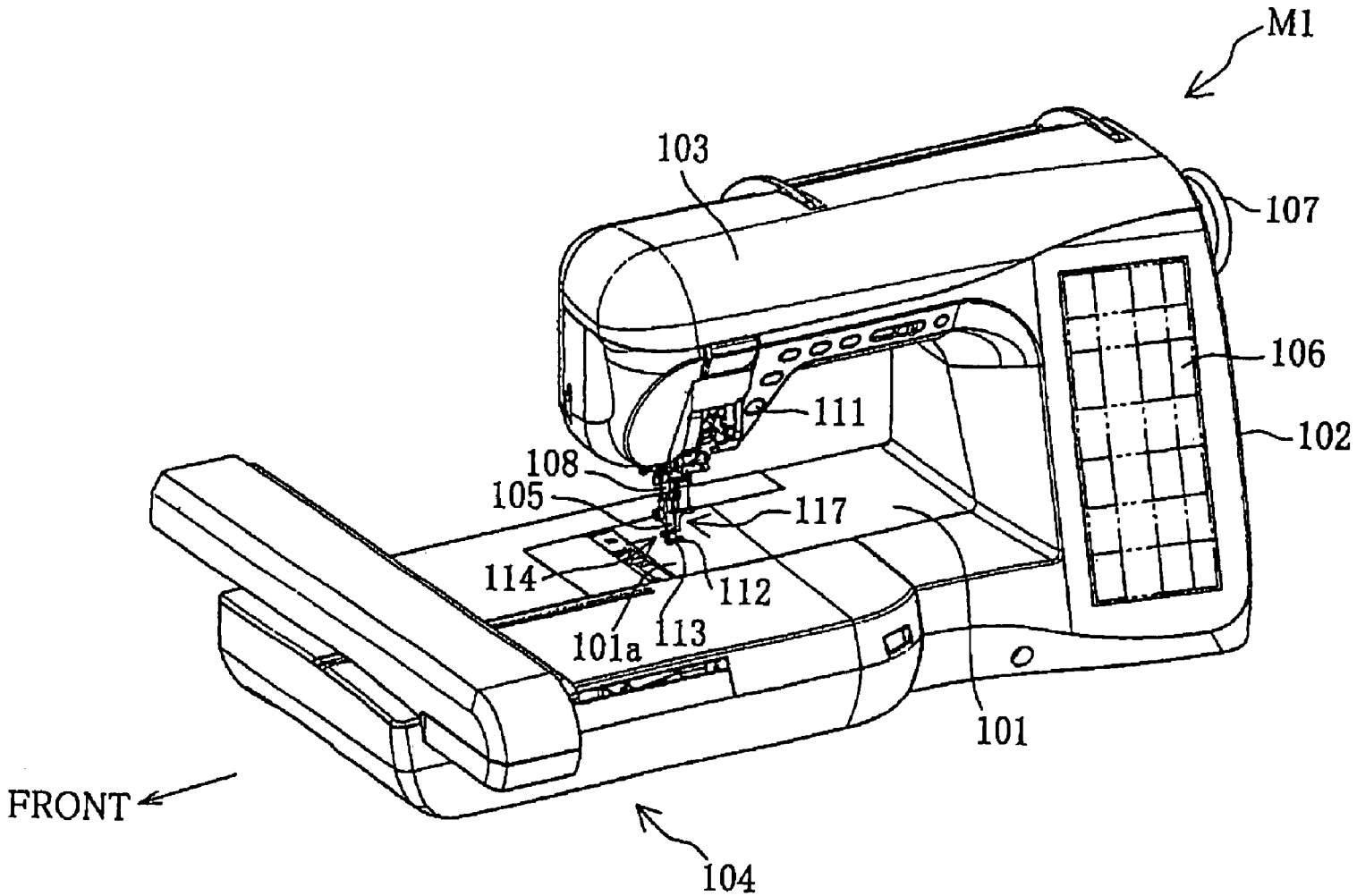
FIG. 18 is a perspective view of an embroidery sewing machine attached with a wiper device according to a second illustrative aspect of the present disclosure.
Figure 19:
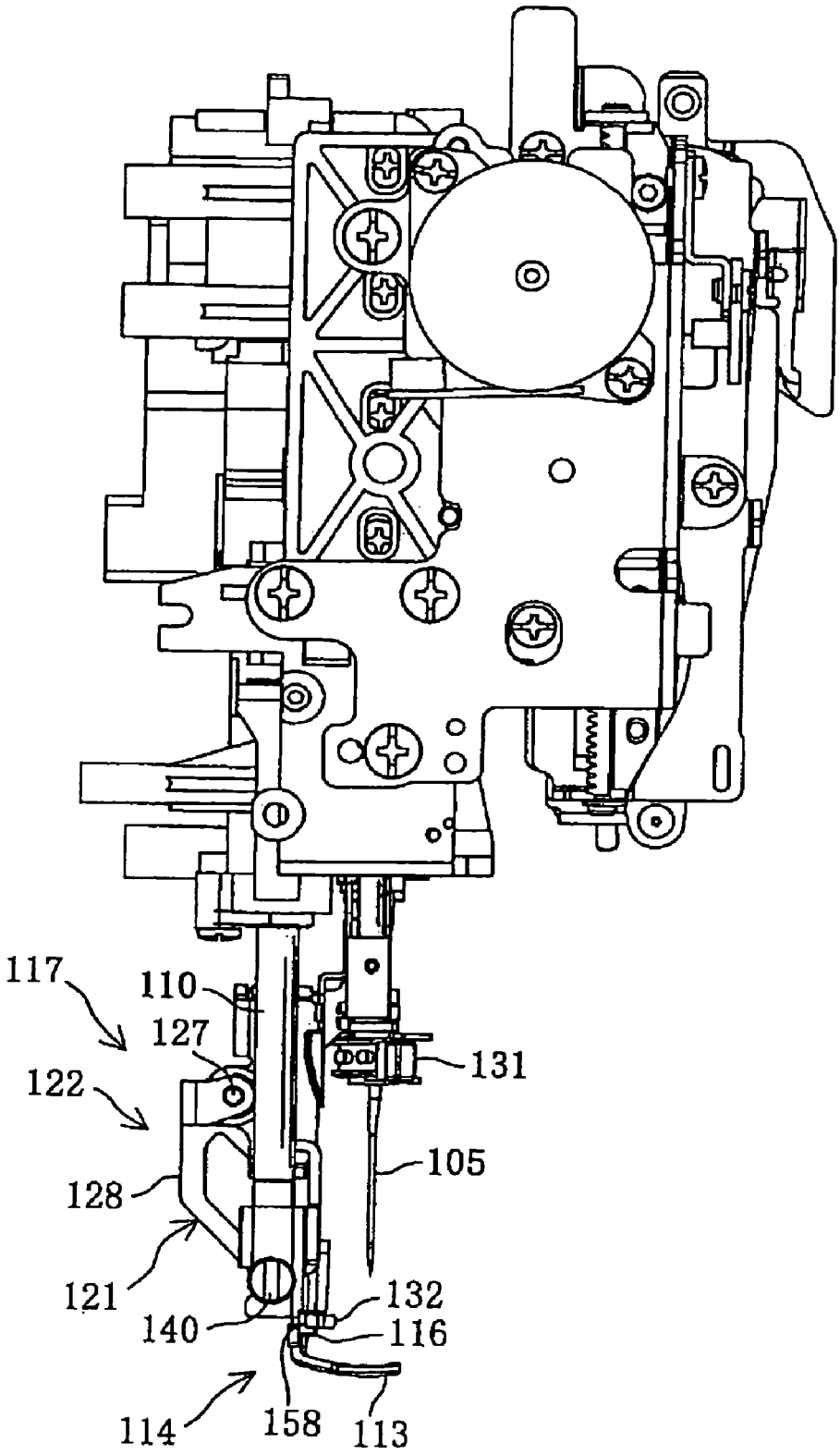
FIG. 19 is a left side view of the wiper device.
Figure 20:
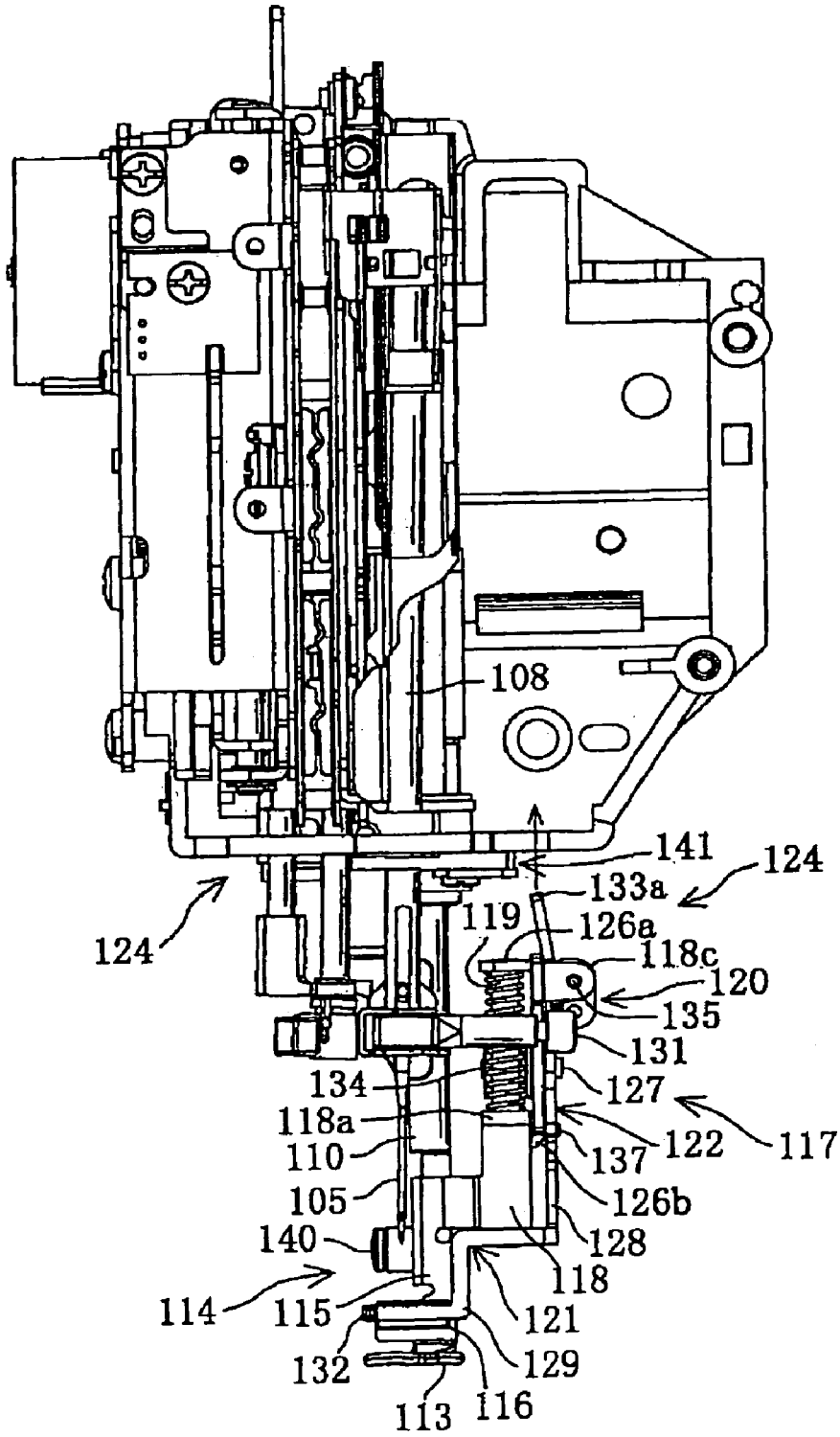
FIG. 20 is a front view of the wiper device.

First, as shown in FIG. 18, a sewing machine M1 capable of embroidery sewing will be described briefly.

The sewing machine M1 is similar to an ordinary house hold electronic sewing machine. The sewing machine M1 includes a bed 101, a foot 102 standing upright from the right end bed 101, and an arm 103 extending leftward from the upper end of the foot 102 and confronting the bed 101. An embroidery frame drive mechanism 104 enabling embroidery sewing using an embroidery frame (not shown) is detachably attached to the left side of the bed 101. The embroidery drive mechanism 104 drives the embroidery frame independently in an X direction (lateral direction) and a Y direction (longitudinal direction) respectively.

Provided under a needle plate 101*a* of the bed 101 are a feed dog vertically moving mechanism (not shown) vertically moving the feed dog and a feed dog longitudinally moving mechanism (not shown) longitudinally moving the feed dog, a hook mechanism (not shown) detachably attaching a bobbin wound with a bobbin thread and a thread cutting unit (not shown) for cutting a needle thread and a bobbin thread, and the like as in an ordinary sewing machine. A liquid crystal display 6 is provided on the front surface of the foot 102.

Provided in the arm 103 are a sewing machine main shaft (not shown) extending in the lateral direction and being rotated by a sewing machine motor, a hand pulley 107 capable of rotating the main shaft by a manual operation, a needle bar drive mechanism (not shown) vertically moving the needle bar 108 having a sewing needle 105 attached to the lower end thereof, a needle swing mechanism 109 (refer to FIG. 27) swinging the needle bar 108 in the lateral direction perpendicular to a cloth feed direction, and a thread take-up drive mechanism (not shown) vertically moving the thread take-up in synchronization with the vertical movement of the needle bar 108. Furthermore, a reciprocating mechanism (not shown) reciprocating a presser bar 110 supported to a sewing machine frame reciprocably between an elevated position and a lowered position by a stepping motor fixed to a sewing machine frame are provided in the arm 103.

Also, a sewing start/stop switch 111, and the like for starting/stopping a sewing operation is provided in the front surface of the arm 103. An embroidery presser foot 114 having a cloth presser 113 is mounted on the presser bar 110 provided in the head of the arm 103 and a penetration hole 112 through which a sewing needle 105 is vertically penetratable is defined in the cloth presser 113. A wiper device 115 that wipes the needle thread-end extending from an eye of the sewing needle 105 so as to pull the needle thread-end above the workpiece cloth W1 after cutting the needle thread by a thread cutting mechanism below the needle plate 101*a* is provided on the embroidery presser foot 114. A later described support member 118, a support shaft 119, and a drive force input mechanism 120, and the like are provided on the embroidery presser foot 114 and the wiper device 117.

Next, the wiper device 117 will be described.

As shown in FIGS. 19 to 25 and 33, the wiper device 117 includes a wiper mechanism 122 having a wiper member 121 performing a thread wiping operation, a wiper drive mechanism 123 driving the wiper mechanism 122 and rendering the thread wiping operation of the wiper member 121, and a switch mechanism 124 switching the wiper member 121 from an operating state to an non-operating state in conjunction with the position of the needle bar 108.

Next, the wiper mechanism 122 and the wiper member 121 will be described based on FIGS. 19 to 22 and 33.

The wiper member 121 is swingably supported about a horizontal pivot shaft 127 of a main body member 126 of a drive force input mechanism 120 provided on an embroidery presser foot 114. The horizontal pivot shaft 127 is disposed parallel to the needle swinging direction (lateral direction). The wiper member 121 includes a circumventing arm 128 and a thread wiping portion 129 and a thread end clamp portion 130 integrally formed on the lower end of the circumventing arm 128.

The circumventing arm 128 is formed such to prevent the wiper member 121 from interfering with a needle fastening member 131 fixing the sewing needle 105 to the needle bar 108 when the wiper member 121 is upwardly swung to wipe the thread.

The thread wiping portion 129 is formed in a crank form in front view. A regulating portion 132 that prevents the needle thread from falling off to the outer side of the thread wiping portion 129 during the upward swing of the wiper member 121 is provided on the distal end of the thread wiping portion 129. A later described thread end clamp portion 130 is provided on the rear portion of the distal end of the thread wiping portion 129.

A support member 118 is integrally formed on the cloth presser 113 mounted on a presser bar 110. A support shaft 119 is vertically fixed to a pair of an upper support piece 118*a* and a lower support piece 118*b* of the support member 118.

The drive force input mechanism 120 includes the main body member 126 supported vertically movably to the support shaft 119 and a laterally swingable abutting member 133 provided on the upper end of the main body member 126. An abutting portion 133*a* is formed on the upper end of the abutting member 133.

A pair of an upper guided portion 126*a* and a lower guided portion 126*b* are formed on the main body member 126. The support shaft 119 is inserted vertically slidably to the lower guided portion 126*b* disposed between the pair of upper support piece 118*a* and the lower support piece 118*b*. The support shaft 119 is inserted vertically slidably to the upper guided portion 126*a* above the upper support piece 118*a*. An elastic member composed of a compression spring 134 is wound on a portion of the support shaft 119 disposed between the upper support piece 118*a* and the upper guided portion 126*a*. The drive force input mechanism 120 is upwardly biased by the compression spring 134.

A pair of front-rear support pieces 118*c* is molded as to protrude to the right in front view on the upper end of the main body member 126, and the horizontal support shaft 135 oriented longitudinally in front view is fixed to the support pieces 118*c*. The abutting member 133 is supported swingably with respect to the horizontal support shaft 135 and unmovably in the shaft direction of the horizontal support shaft 135. Also, the abutting member 133 is biased counterclockwise in front view by the elasticity of the twisted coil spring 136 wound on the horizontal support shaft 135 and is supported by the main body member 126 in a locked disposition. The abutting member 133 is swingable at approximately 30° clockwise from the locked disposition.

Next, the link mechanism 125 will be described.

Figure 25:
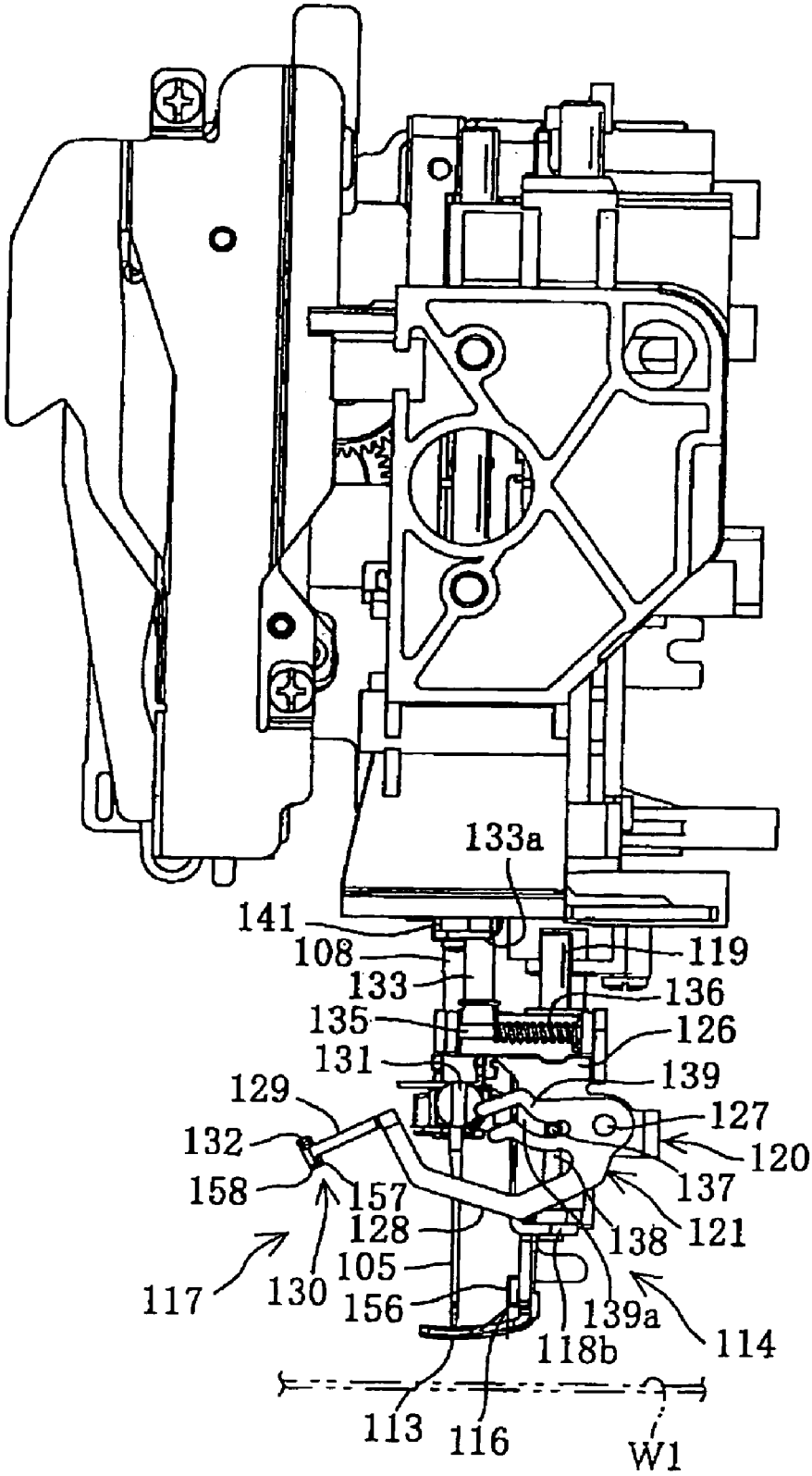
FIG. 25 is a right side view indicating the operating state of the wiper member.
Figure 26:
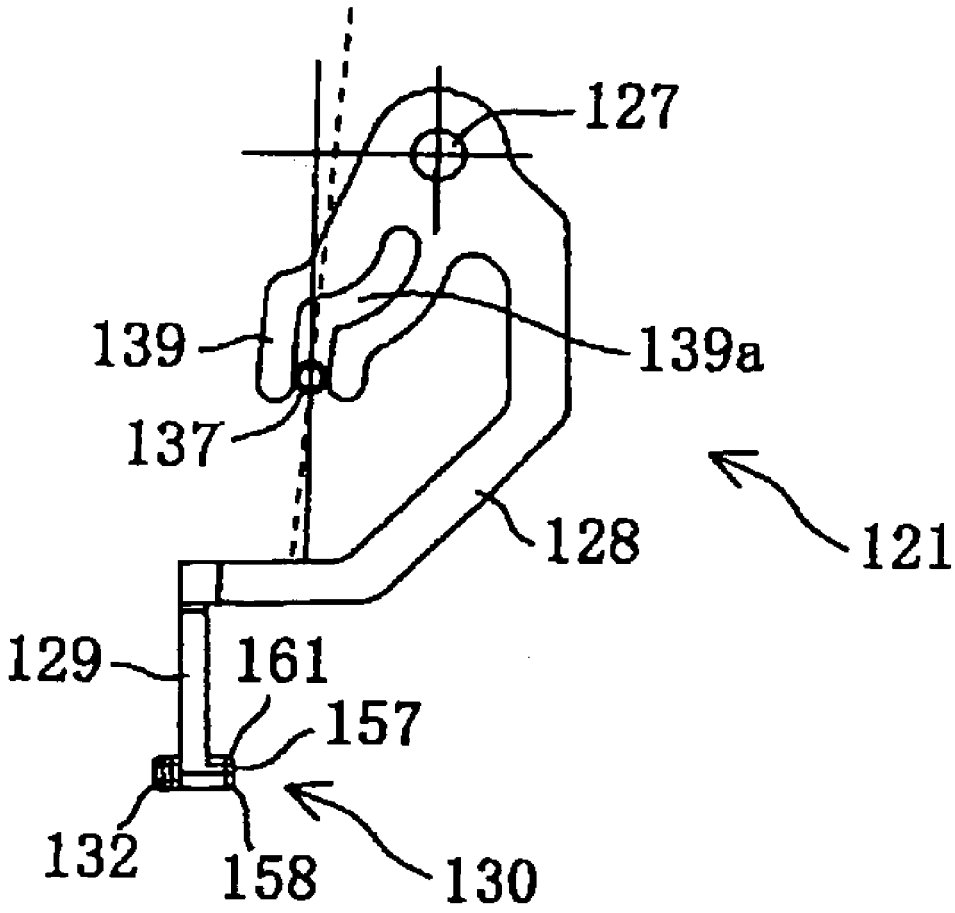
FIG. 26 is an exploded right side view of the wiper member.

As shown in FIGS. 21, 22, 25, 26 and 33, the link mechanism 125 includes a drive pin 119 implanted in a direction parallel to the needle swinging direction on a substantial vertical mid section of the support shaft 119; a slit 138 defined in a vertically elongated manner in the main body member 126, a link arm 139 integrally molded with the wiper member 121 and a link slit 139*a* defined on the link arm 139. The drive pin 119 is slidably inserted to both the slit 138 and the link slit 139*a*. As shown in FIG. 26, a linear portion of the link slit 139*a* is inclined with respect to the vertical direction (up-down direction) so as to extend rearwardly upward.

Figure 21:
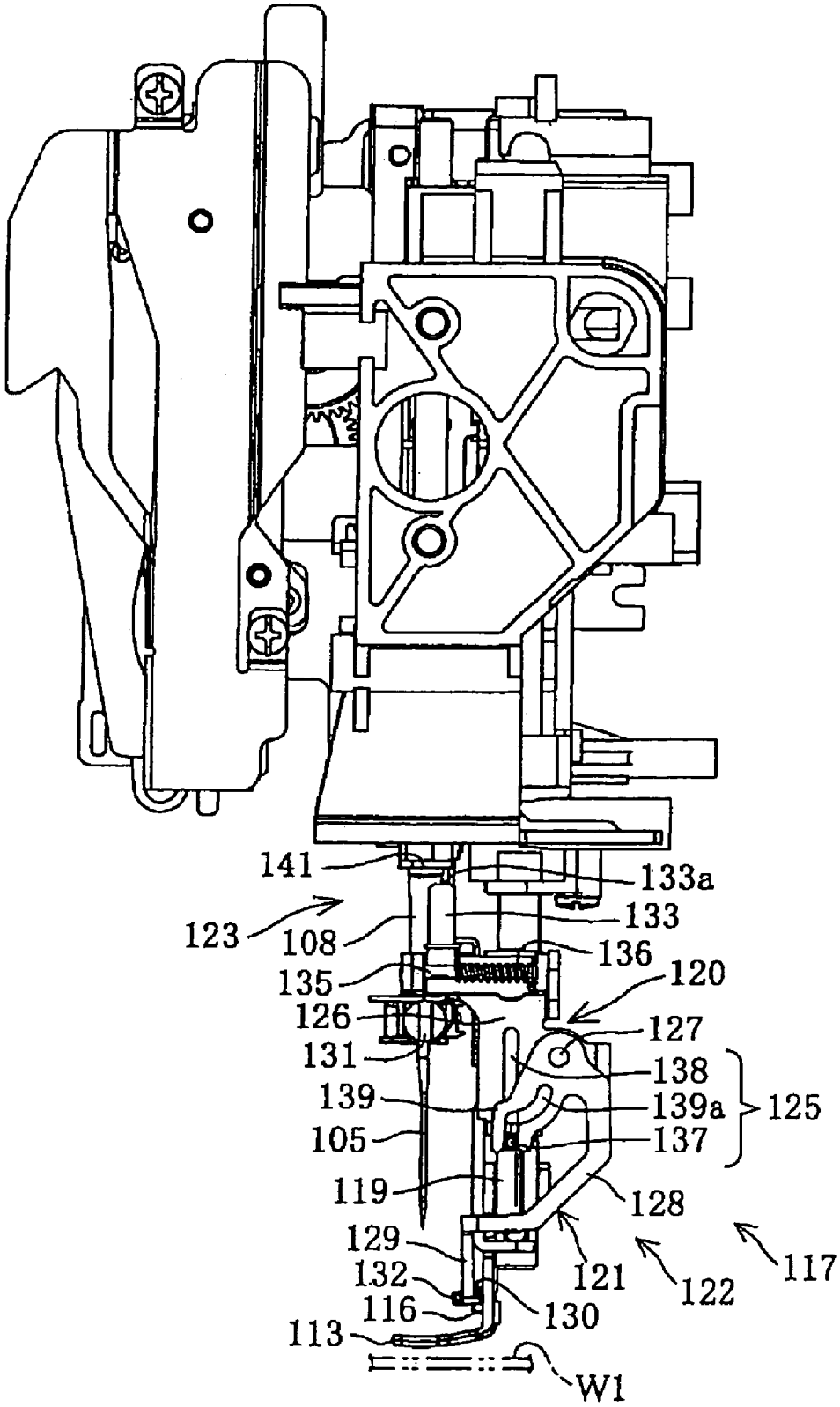
FIG. 21 is a right side view of the wiper device.
Figure 22:
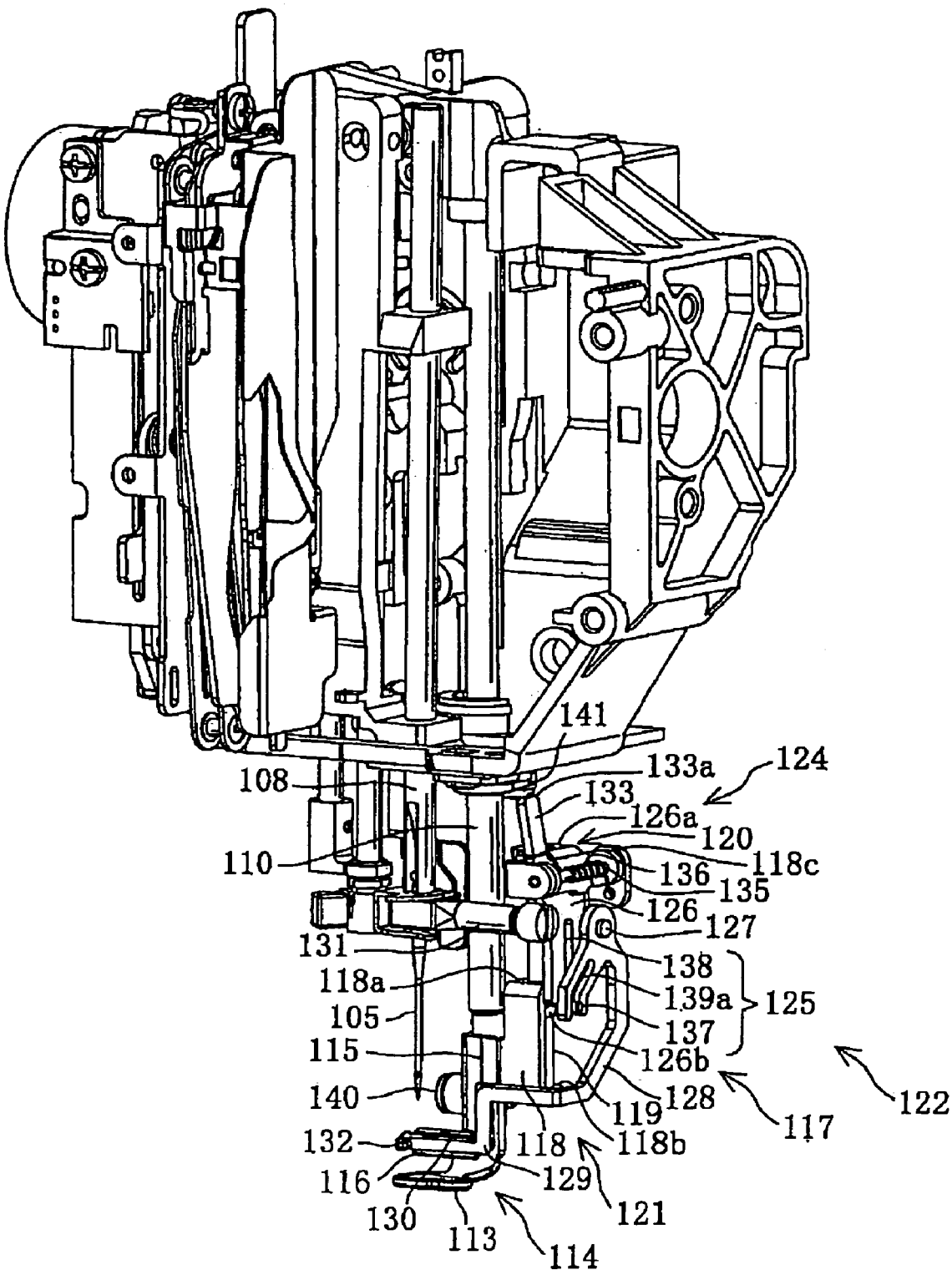
FIG. 22 is a perspective view of the wiper device.
Figure 23:
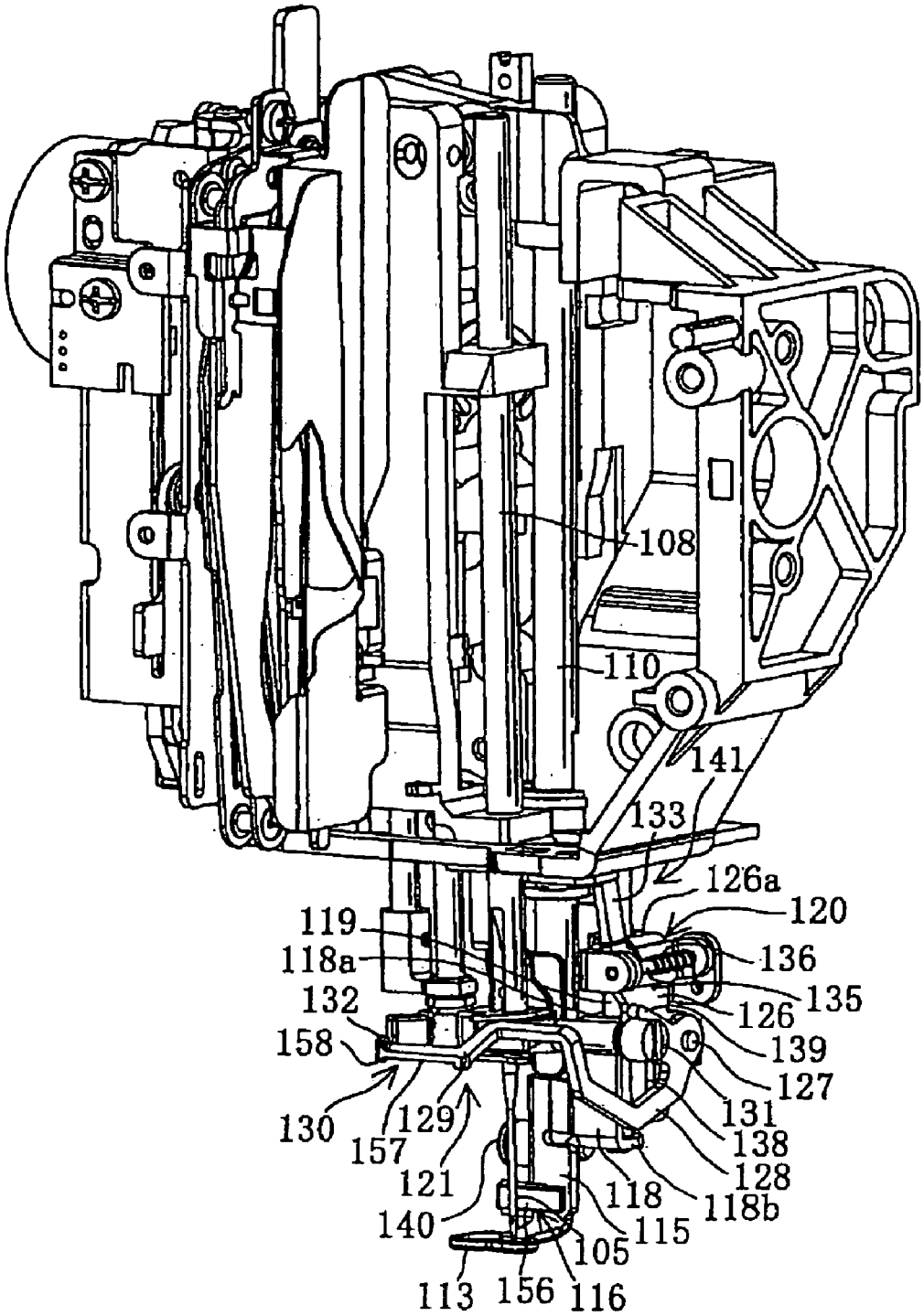
FIG. 23 is a perspective view indicating the operating state of the wiper member.
Figure 24:
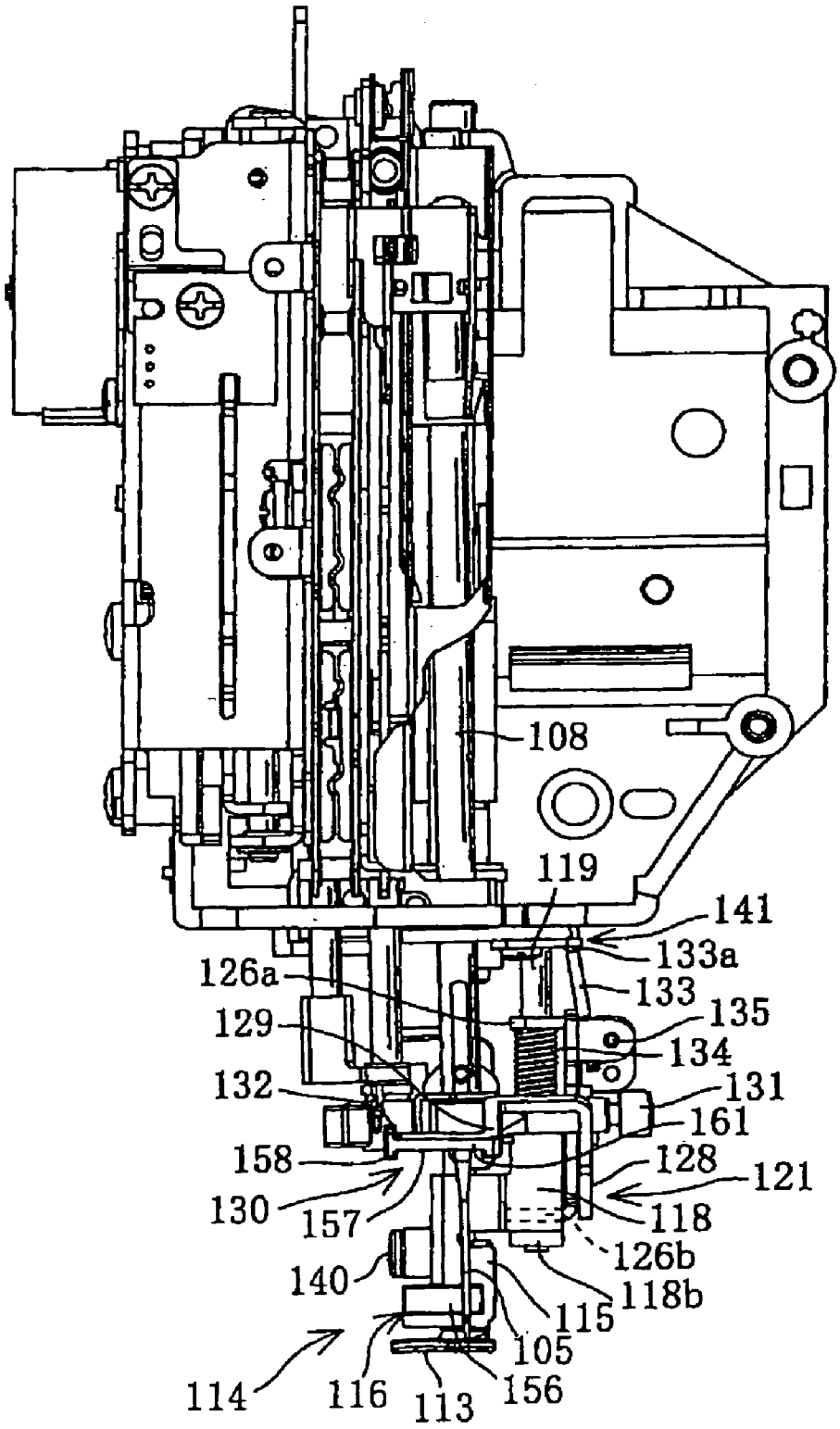
FIG. 24 is a front view indicating the operating state of the wiper member.
Figure 33:
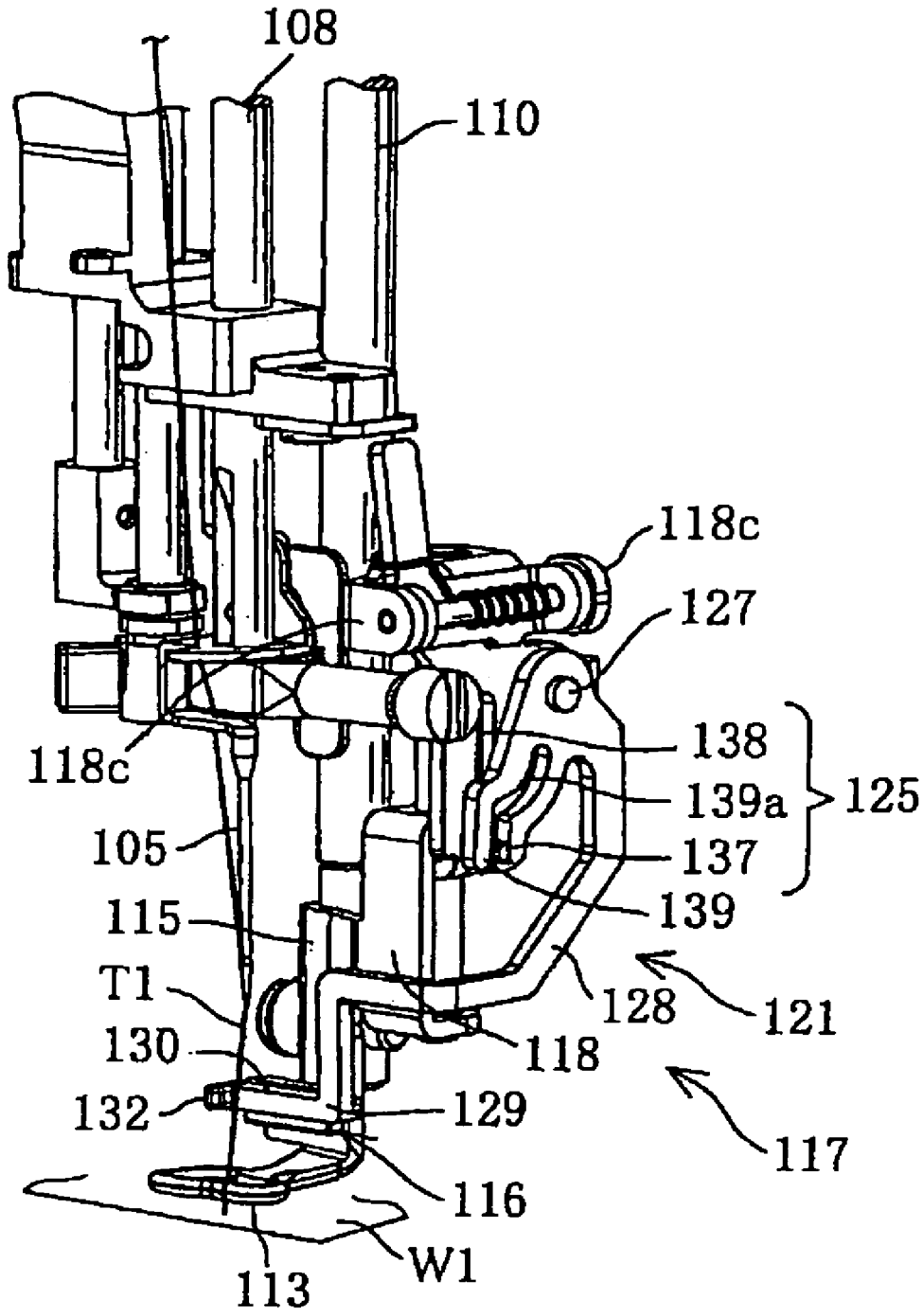
FIG. 33 is a perspective view illustrating a completion of a sewing operation.
Figure 34:
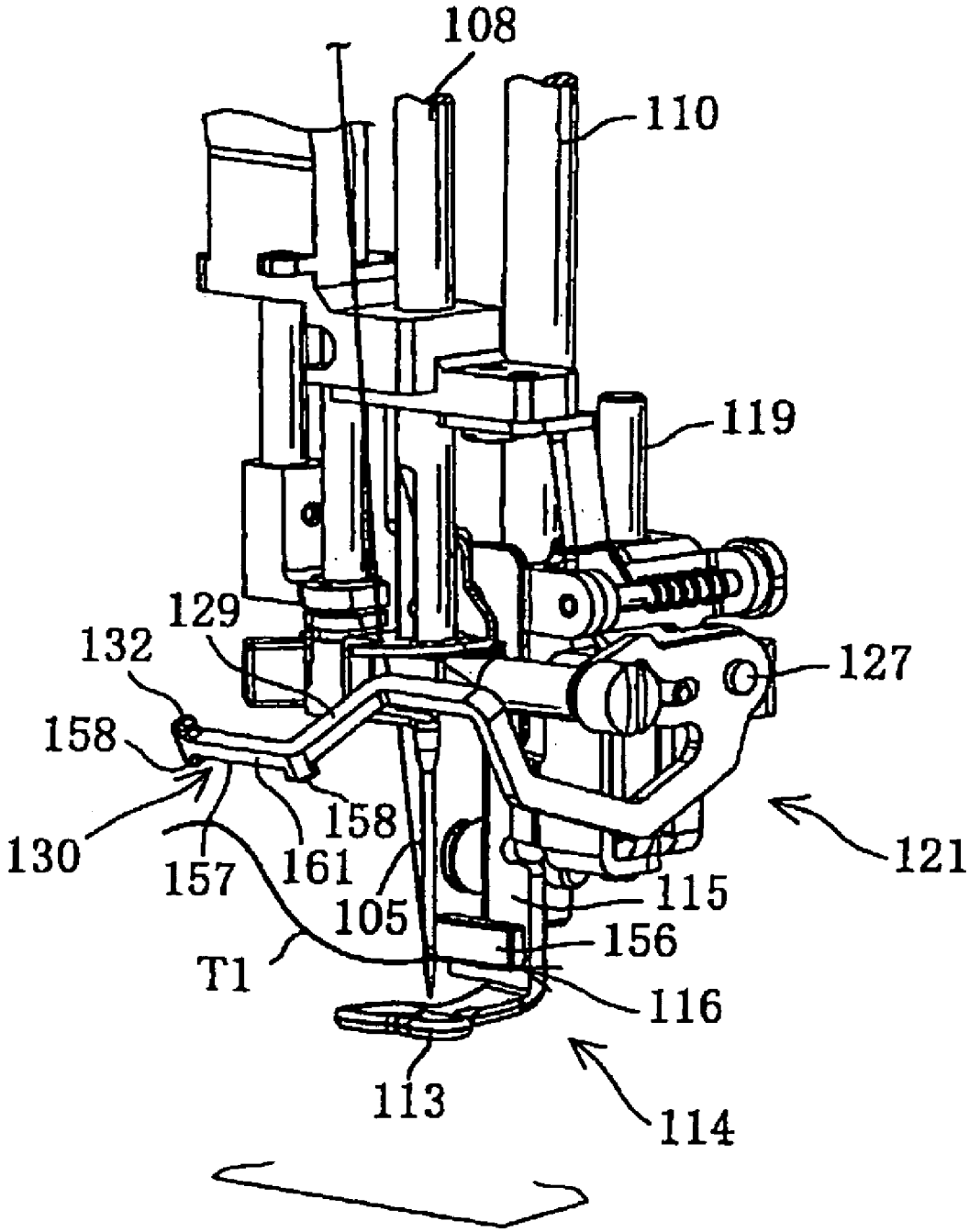
FIG. 34 is a perspective view illustrating the wiper member performing the thread wiping operation.

When the main body member 126 is downwardly moved without moving the vertical location of the support member 118 mounted on the presser bar 110, the location of the horizontal support shaft 25 fixed to the main body member 126 is relatively lowered with respect to the drive pin 137. Thus, the link slit 139*a* of the wiper member 121 is displaced from a forwardly oriented lower oblique disposition as shown in FIGS. 21 and 33 to a forwardly oriented upper oblique disposition as shown in FIGS. 25 and 34. Consequently, as shown in FIGS. 21 and 33, when a thread wiping portion 129 of the wiper member 121 is displaced from the clamp portion to the operating position in front of the needle fastening member 131 as shown in FIGS. 25 and 34.

Next a wiper drive mechanism 123 that drives the wiper member 121 by the vertical movement of the presser bar 110 will be described. The wiper drive mechanism 123 driven by a vertically moving mechanism that vertically drives the presser bar 110. On the lower end of the presser bar 110, the lower end of the embroidery presser foot 114 is fixed thereto by a clamping screw 140. The support member 118 integrally formed with the embroidery presser foot 14 is also vertically moved by the vertical movement of the presser bar 110.

In case the abutting portion 133*a* of the abutting member 31 is in a position capable of abutting a needle bar base 141 described later, the support member 118 is elevated along with the elevation of the presser bar 110 and the abutting portion 133*a* abuts the needle bar base 141. When the abutting portion 133*a* abuts the needle bar base 141, the abutting portion 133*a* is thereafter locked in such position. In case the support member 118 is further elevated along with the presser bar 110, as described earlier, the position of the horizontal support shaft 127 fixed to the main body member 126 is moved relatively downward with respect to the drive pin 137. Thus, the wiper member 121, as shown in FIGS. 21 and 33, moves from the stand-by position in which the wiper member 121 is non-operating, to the position in front of the needle fastening member 131 as shown in FIGS. 25 and 34.

Next, a switch mechanism 124 will be described hereinafter.

As shown in FIGS. 20 and 22, and 27 to 29, the switch mechanism 124 includes a needle swing mechanism 109 and a needle bar base 141 supporting the needle bar 108 in a vertically slidable manner.

A description will be given on the needle swing mechanism 109 that swings the needle bar 108.

Figure 27:
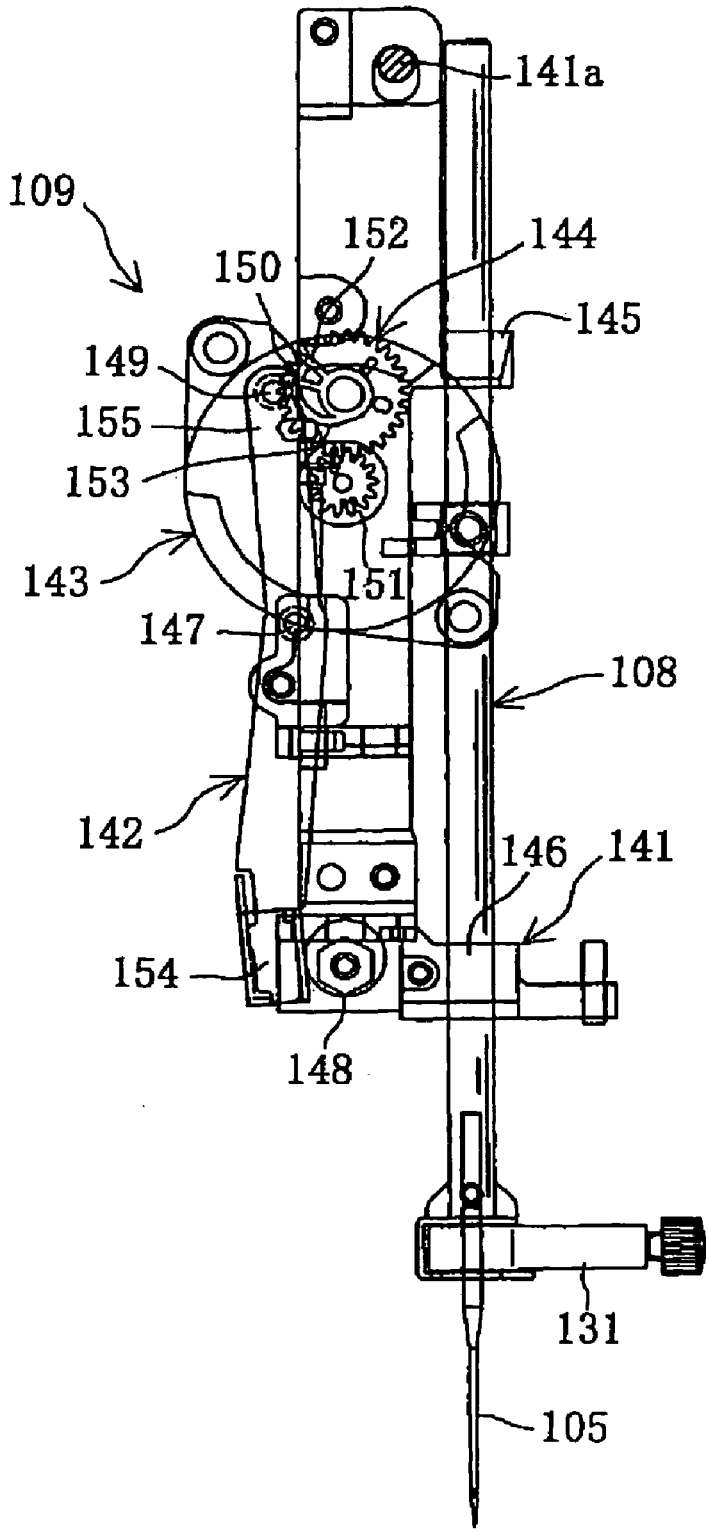
FIG. 27 is a front view of the needle swing mechanism.
Figure 28:
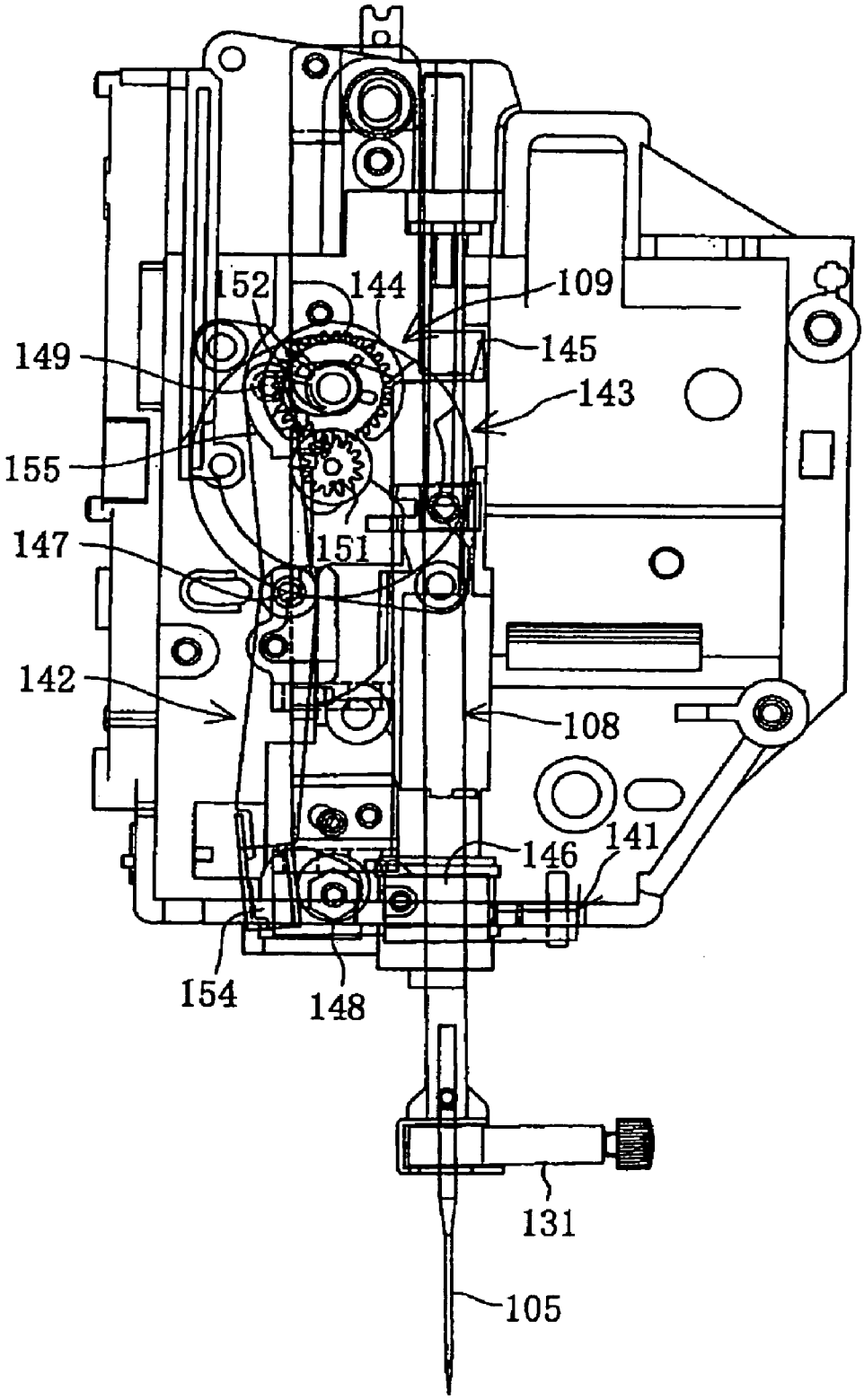
FIG. 28 is a front view of the needle swing mechanism wherein a needle bar is swung to the right.
Figure 29:
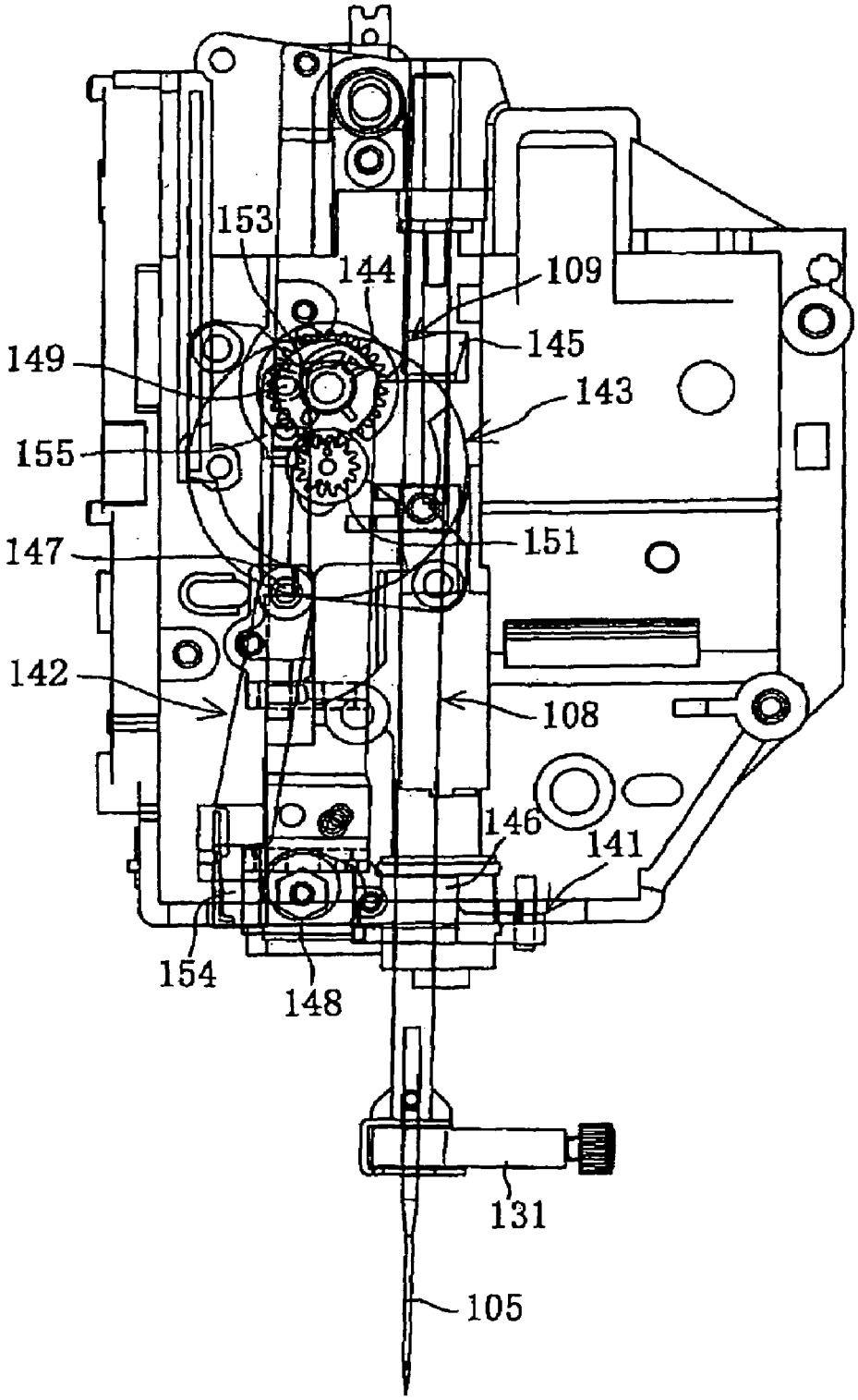
FIG. 29 is a front view of the needle swing mechanism wherein the needle bar is swung to the left.

As shown in FIGS. 27 to 29, the needle swing mechanism 109 includes a needle bar base 141, a swing lever 142, a stepping motor 143, and a swing cam 144, and the like.

As shown in FIG. 27, the needle bar base 141 is in a vertically extending form substantially parallel to the needle bar 108 and is arranged left side vicinity of the needle bar 108. The upper end of the needle bar 108 is swingably supported to a swing machine frame by a support shaft 141*a*. The needle bar base 141 has an upper pivotal portion 145 and a lower pivotal portion 145 vertically movably supporting the needle bar 108. Therefore, when the needle bar base 141 is swung in the lateral direction, the needle bar 108 is swung in the lateral direction as well.

The swing lever 142 is in a vertically extending form substantially parallel to the needle bar base 141, and the substantial vertical mid section thereof is pivotally supported swingably with respect to a pivot pin 147 supported by the sewing machine frame. A lower end 154 of the swing lever 142 abuts a cam body 148 fixed to the lower end of the needle bar base 141 and an upper end 48 of the swing lever 142 has a pin 149 fixed thereto which abuts a cam surface 150 of the swing cam 144 that laterally swings the needle bar base 141. The lower end of the needle bar base 141 is leftwardly biased by a coil spring not shown such to retain the aforementioned abutments respectively.

The swing cam 144 is rotatably supported by the sewing machine frame and the stepping motor 143 fixed to the sewing machine frame drives the swing cam 144. A gear in mesh engagement with a drive gear 151 of the stepping motor 143 is formed on the outer periphery of the swing cam 144. The cam surface 150 formed in a continuation of a large-radius cam surface 152 distanced away from the rotational shaft center and a small-radius cam surface 153 in close distance with the rotary shaft center is provided in the swing cam 144.

As shown in FIG. 28, the swing cam 144 is rotated by the rotation of the stepping motor 143, and when the pin 149 contacts the large-radius cam surface 152 distanced away from the rotary shaft center of the swing cam 144, the upper end 155 of the swing lever 142 is moved to the left. Then, since the lower end 154 of the swing lever 142 moves to the right via the pivot pin 147, the needle bar base 141 also moves to the right.

As shown in FIG. 29, the swing cam 144 is rotated by the rotation of the stepping motor 143 and when the pin 149 contacts the small-radius cam surface 153 in close distance with the rotary shaft center of the swing cam 144, the upper end 155 of the swing lever 142 moves to the right. Then, since the lower end 154 of the swing lever moves to the left via the pivot pin 147, the needle bar base 141 also moves to the left.

That is, when the lower end 154 of the swing lever 142 moves to the right by the needle swing mechanism 109, the needle bar base 141 moves to a position in which the abutting member 133 and the abutting portion 133*a* can be abutted thereto.

At this point, when the embroidery presser foot 114 and the support member 118 are elevated by the elevation of the presser bar 110, the abutting portion 133*a* abuts the needle bar base 141 and activates the wiper member 121.

On the other hand, when the lower end 154 of the swing lever 142 is moved to the left, the needle bar base 141 is moved to a retracted position incapable of abutting the abutting portion 133*a*. Therefore, the even if the support member 118 is elevated with the embroidery presser foot 114 by the elevation of the presser bar 110, the abutting portion 133*a* does not abut the needle bar base 141 and is merely positioned in the right side of the needle bar base 141. Hence the wiper member 121 is not activated. Thus, the switch mechanism 124 is constituted by the needle swing mechanism 109 and the needle bar base 141 supporting the needle bar 108 vertically slidably.

Next, a thread end clamp member 116 formed on the embroidery presser foot 114 and a thread end clamp portion 130 formed on the wiper member 121 will be described.

Figure 30:
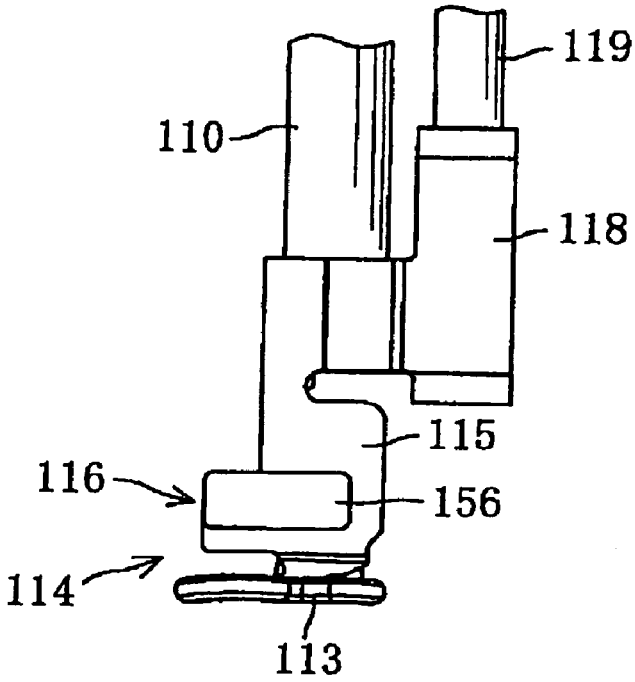
FIG. 30 is an exploded front view of a main portion of a cloth presser.
Figure 31:
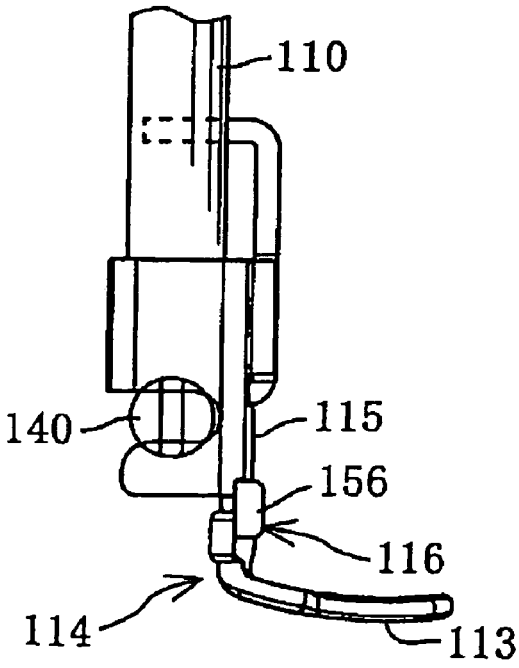
FIG. 31 is an exploded left side view of the main portion of the cloth presser.
Figure 32:
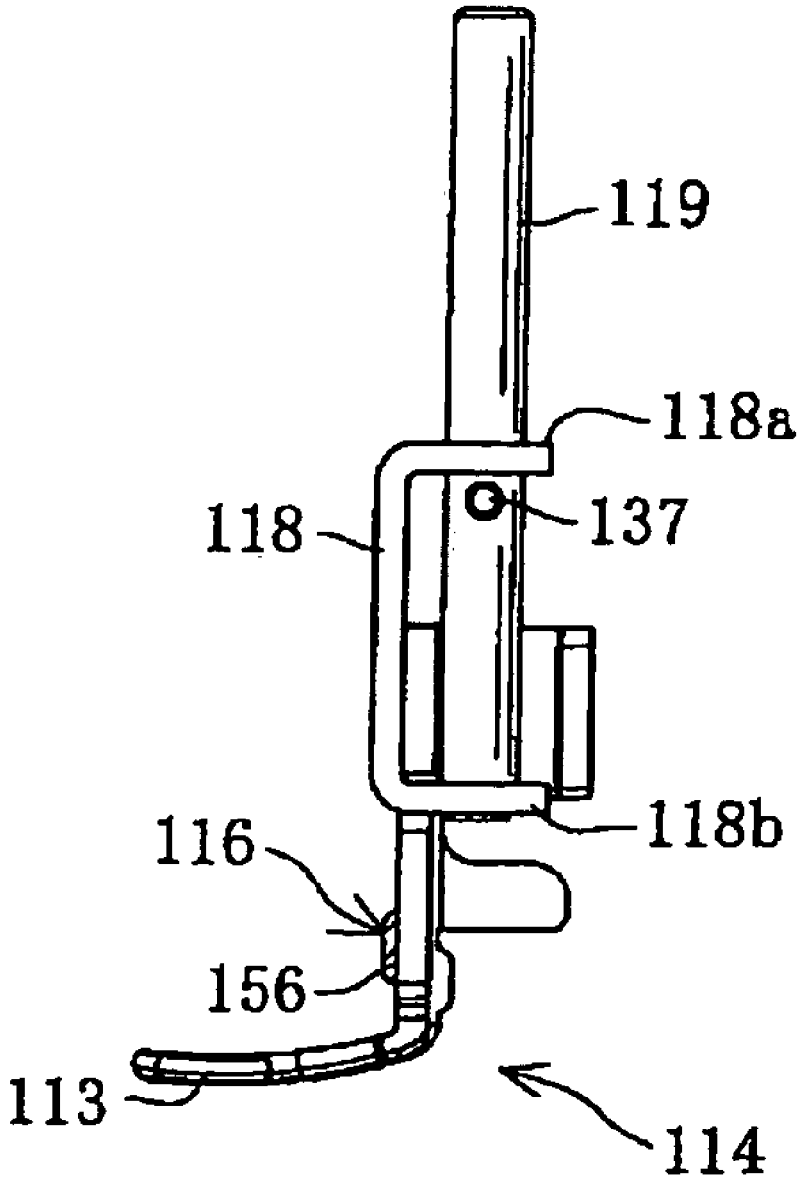
FIG. 32 is an exploded right side view of the main portion of the cloth presser.

As shown in FIGS. 30 to 32, the thread end clamp member 116 is constructed by a rubber-made magnet piece 156 having a magnet in a horizontally-elongated oblong form and is adhesively fixed to the cloth presser main body 115 of an embroidery presser foot 114 in a forwardly protruding manner with respect to the cloth presser main body 115.

As shown in FIGS. 23 to 26 and 34, the thread end clamp portion 130 made of magnetic steel is integrally molded to the rear surface of the distal end of the thread wiping portion 129 of the wiper member 121. The thread end portion 130 includes a thread clamp surface 157 abutting the magnet piece 156, a pair of protrusions 158 provided near the lateral ends of the thread clamp surface 157 and guiding the wiped needle thread-end contacting the thread clamp surface 157 so as not to fall off from the thread clamp surface 157. When the wiper member 121 moves from the operating position in which the thread wiping is performed to the clamp position, after the thread clamp surface 157 catches the wiped needle thread-end, the needle thread-end is clamped by the thread clamp surface 157 and the magnet piece 156. At this point, since the thread clamp surface 157 is attracted by the magnetic force of the magnet piece 156, the needle thread-end is clamped reliably.

The operation and effect of the above described wiper device 117 will be explained hereinafter.

FIG. 33 illustrates a needle thread T1 cut by a needle cutting unit not shown provided on the bed 101 after completion of a sewing operation. In such state, when the presser bar 110 is elevated after moving the needle bar 108 to the right by the needle swing mechanism 109, the abutting portion 133*a* abuts the needle bar base 141 and as shown in FIG. 34, the wiper member 121 is moved to perform the thread wiping operation and pulls up the thread end of the needle thread T1 above the workpiece cloth W1.

Figure 35:
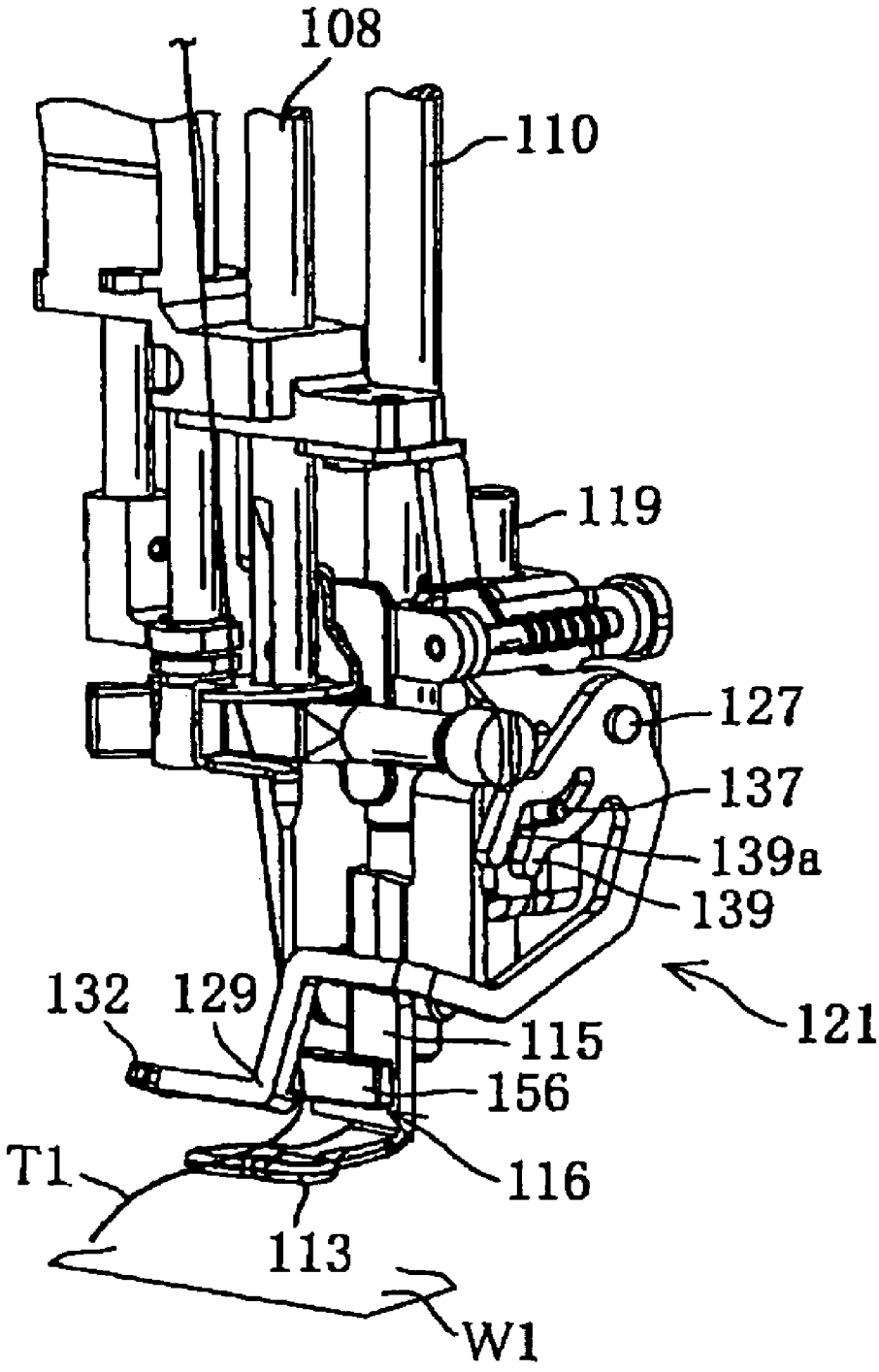
FIG. 35 is a perspective view illustrating the wiper member moving to a clamp position.
Figure 36:
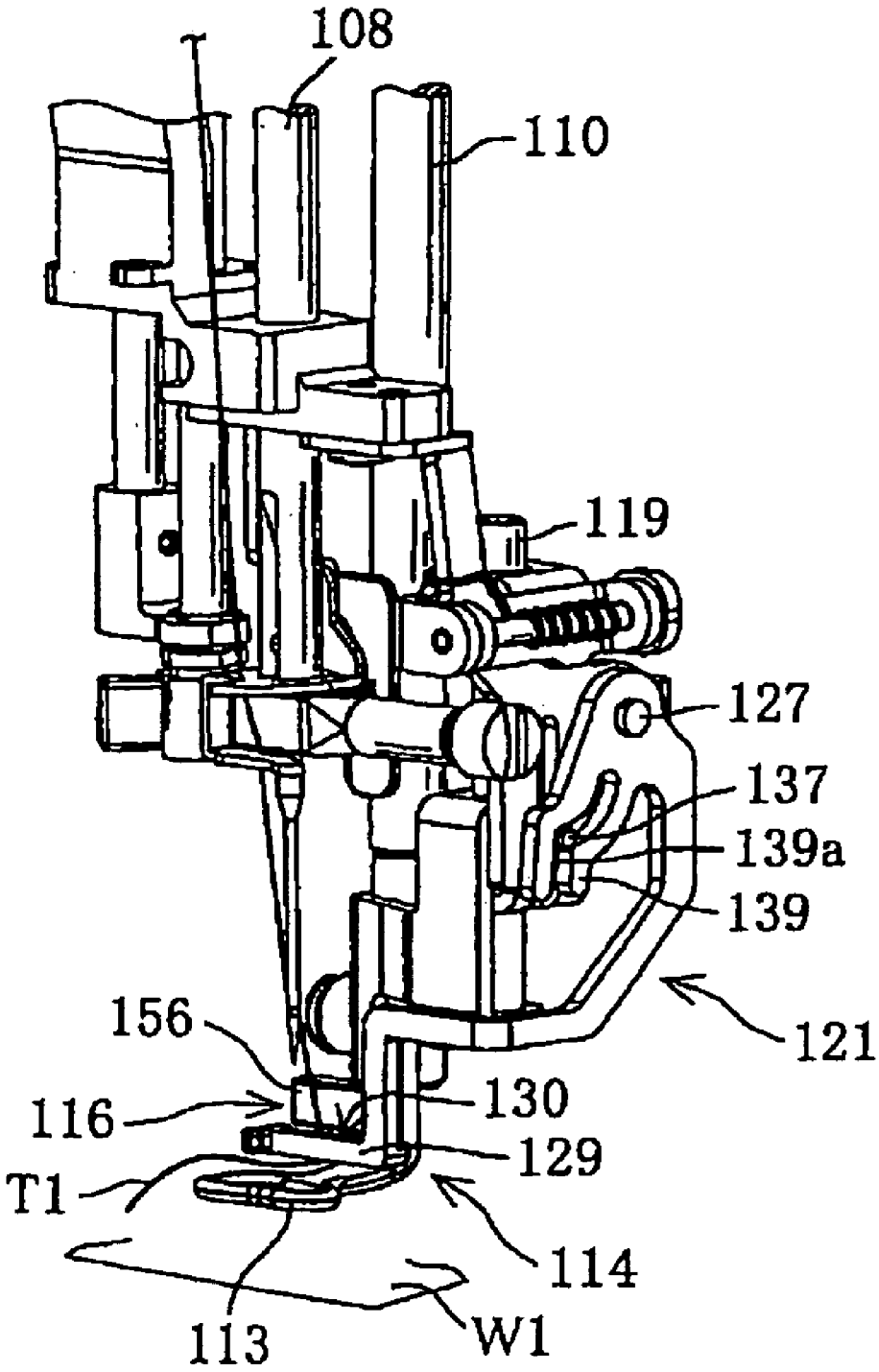
FIG. 36 is a perspective view illustrating the wiper member moving to a vicinity of the clamp position.
Figure 37:
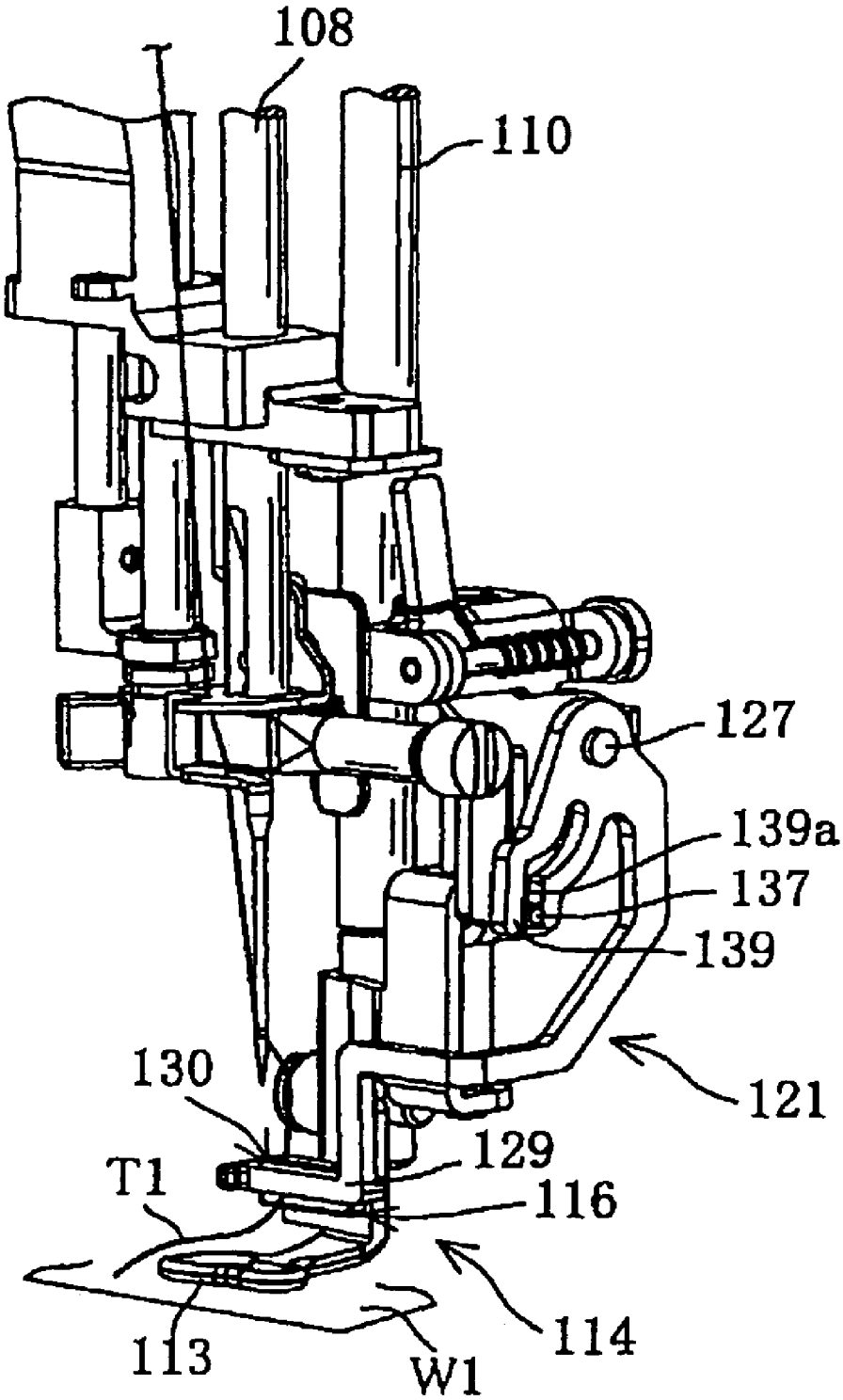
FIG. 37 is a perspective view illustrating the wiper member moved to the clamp position and a needle thread-end is clamped by thereby.

Next, as shown in FIG. 35, when the presser bar 110 is lowered, the wiper member 121 is lowered and the thread clamp surface 157 of the thread clamp portion 130 contacts the thread end of the wiped needle thread T1. Subsequently, as shown in FIG. 36, when the presser bar 110 is further lowered and the wiper member 121 is lowered to a position in which thread clamp surface 157 is substantially in close confrontation with the magnet piece 156, the thread end of the needle thread T1 is caught between the magnet piece 156 and the thread clamp portion 130. Then as shown in FIG. 37, when the wiper member 121 moves to the clamp position the thread end of the needle thread T1 is clamped by the thread clamp surface 157 of the thread clamp portion 130 and the magnet piece 156.

Figure 38:
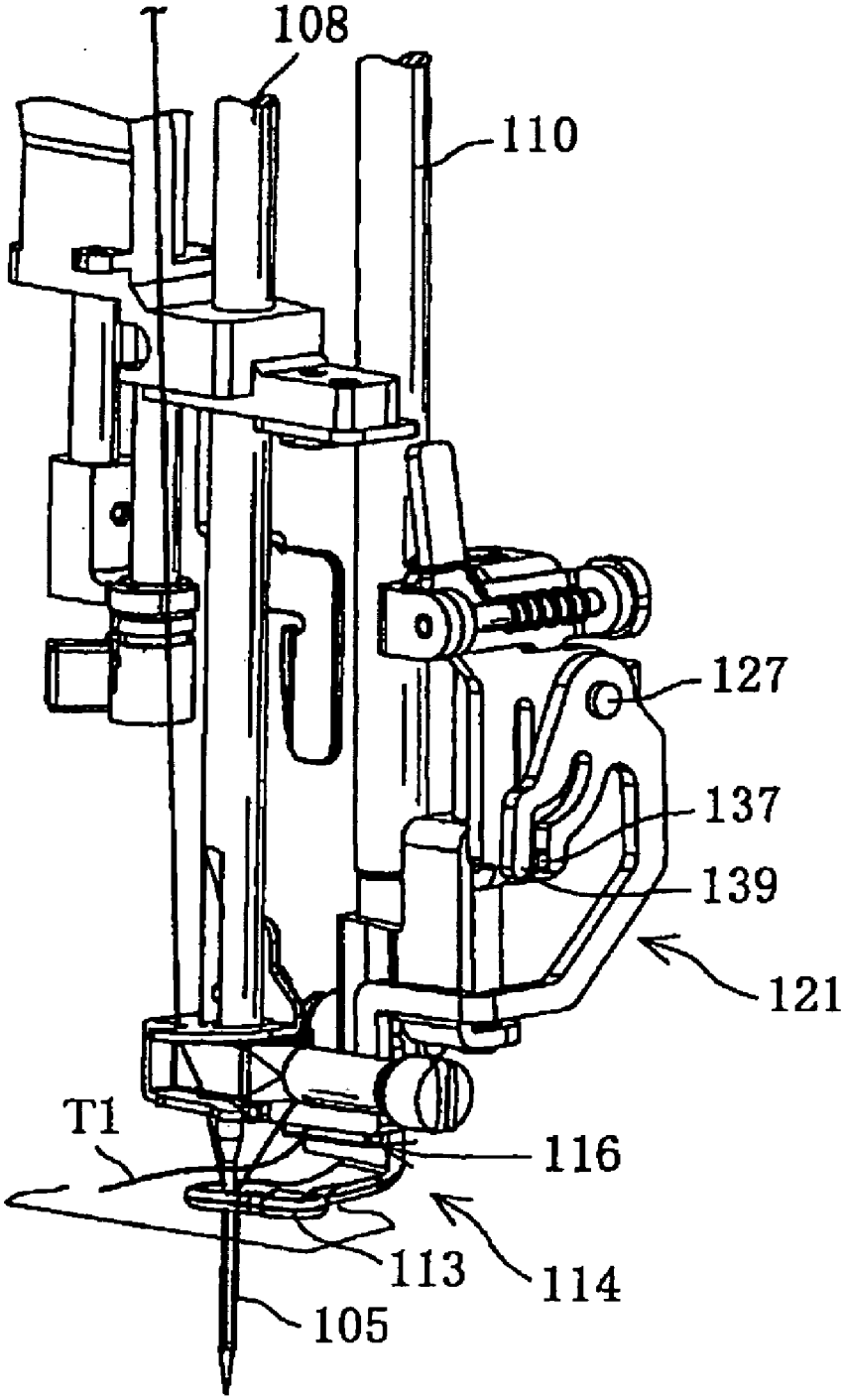
FIG. 38 is a perspective view illustrating a start of a sewing operation, with the needle bar lowered, after the needle thread-end is clamped.
Figure 39:
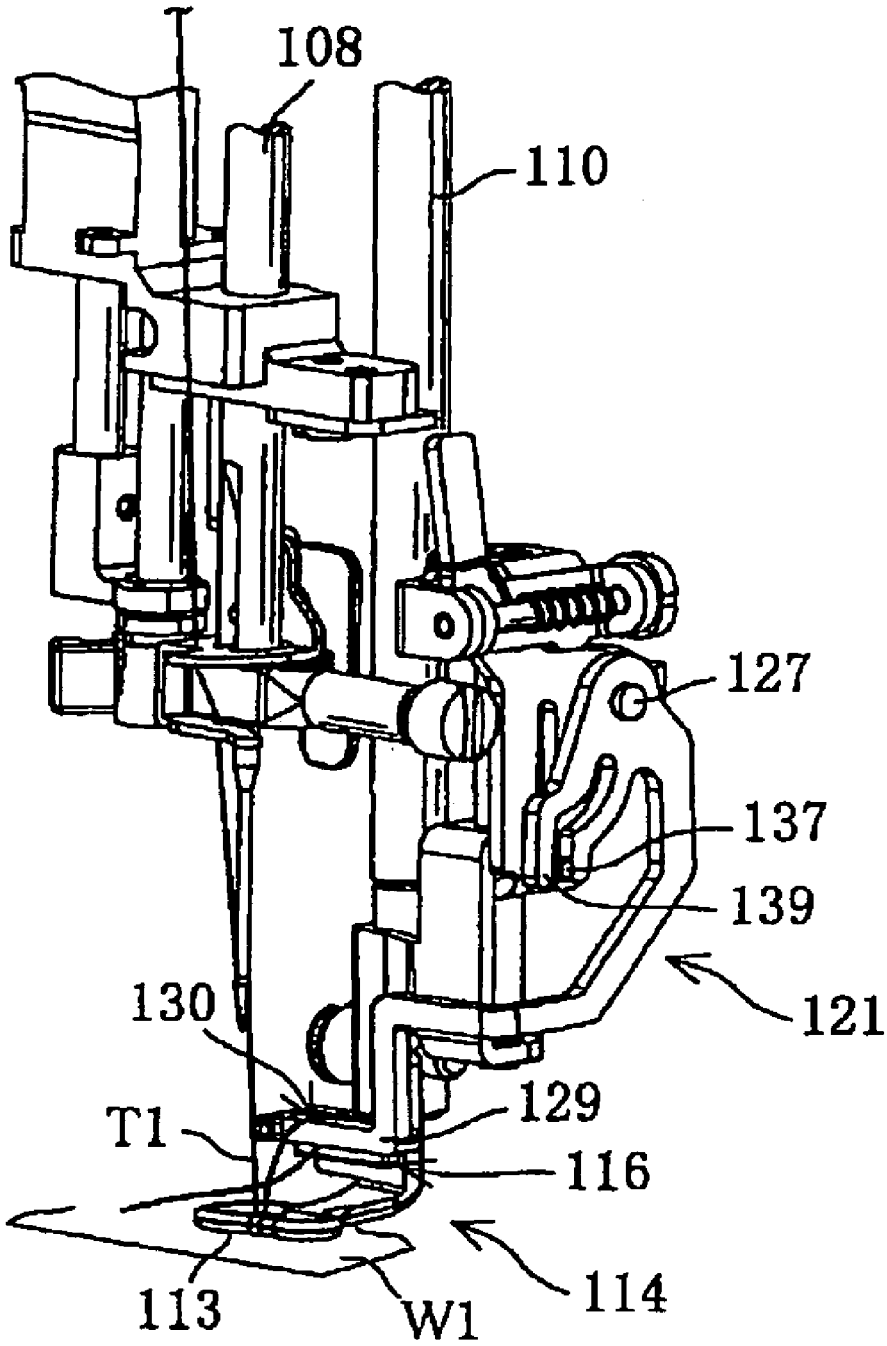
FIG. 39 is a perspective view illustrating an elevated needle bar after being lowered.
Figure 40:
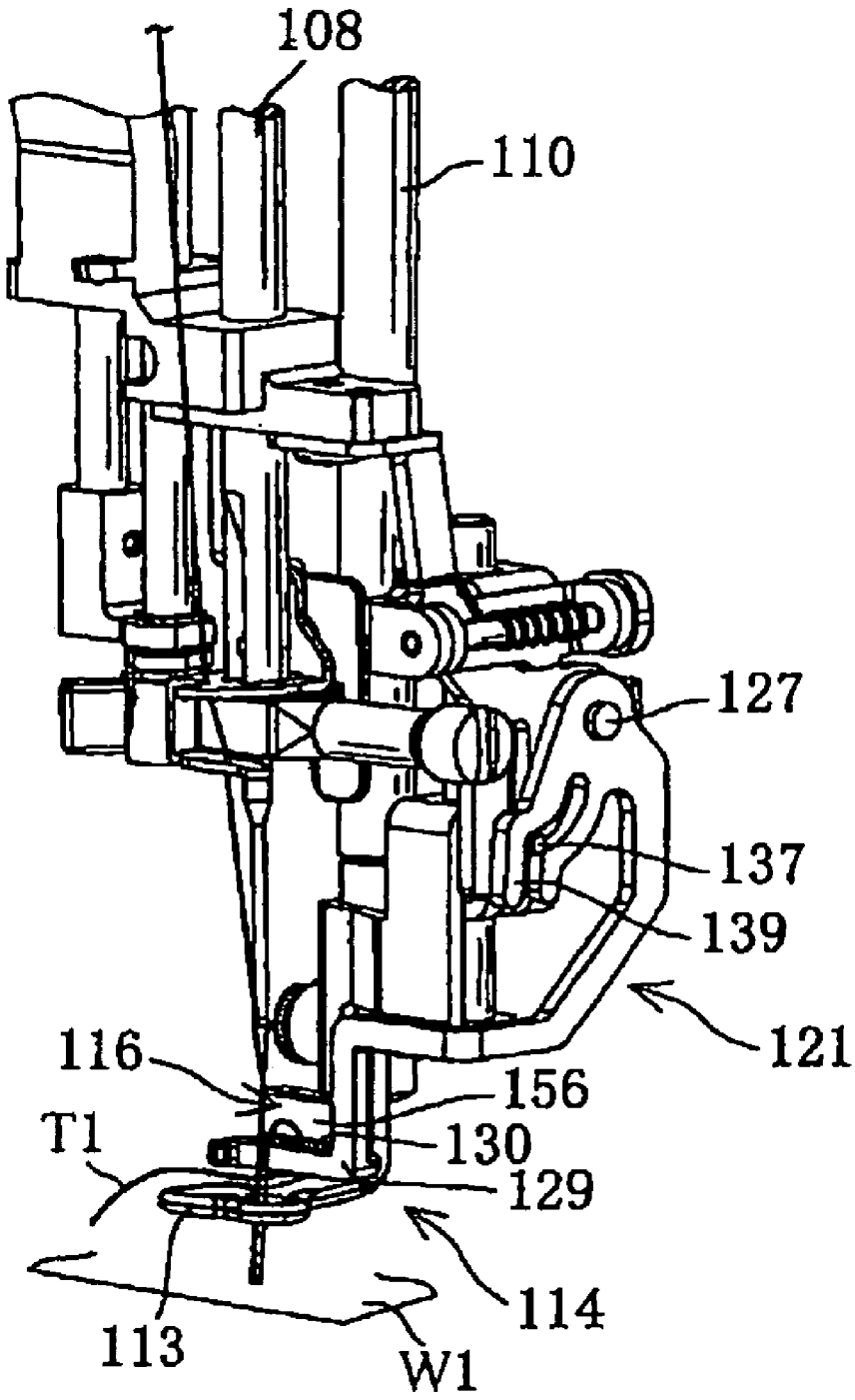
FIG. 40 is a perspective view illustrating the wiper member in a release position.
Figure 41:
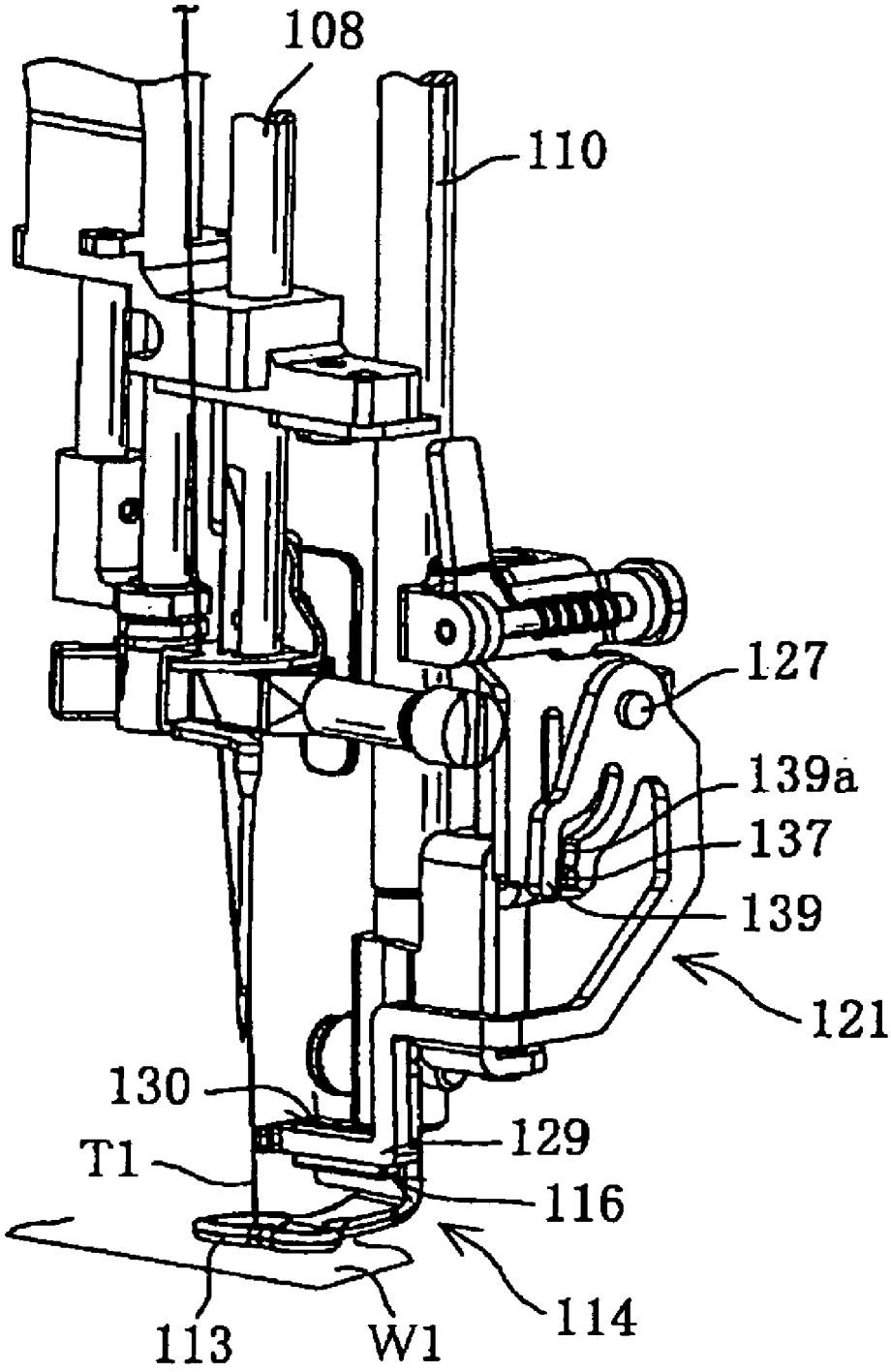
FIG. 41 is a perspective view illustrating the wiper member moved from the release position to the clamp position.

Thereafter, when the subsequent sewing operation is started, as shown in FIG. 38, the needle bar 108 is lowered by the needle bar drive mechanism not shown with the thread end of the needle thread T1 in clamped state. Then, the sewing needle 105 attached to the lower end of the needle bar 108 passes through the penetration hole 112 of the cloth presser 113 and penetrates the workpiece cloth W1. Next, as shown in FIG. 39, sewing needle 105 is pulled out of the workpiece cloth W1 by the elevation of the needle bar 108. Subsequently, when the presser bar 110 is elevated by a predetermined small distance (4 mm), the wiper member 121, as shown in FIG. 40, is moved to the release position distanced toward the operating position by a predetermined distance from the clamp position. Then, the clamping of the thread clamp surface 157 and the magnet piece 156 clamping the thread end of the needle thread T1 therebetween is released and the needle thread end of the needle thread T1 is removed threrefrom. Then, when the needle bar 110 is lowered, as shown in FIG. 41, the wiper member 121 is moved to the clamp position.

Figure 42:
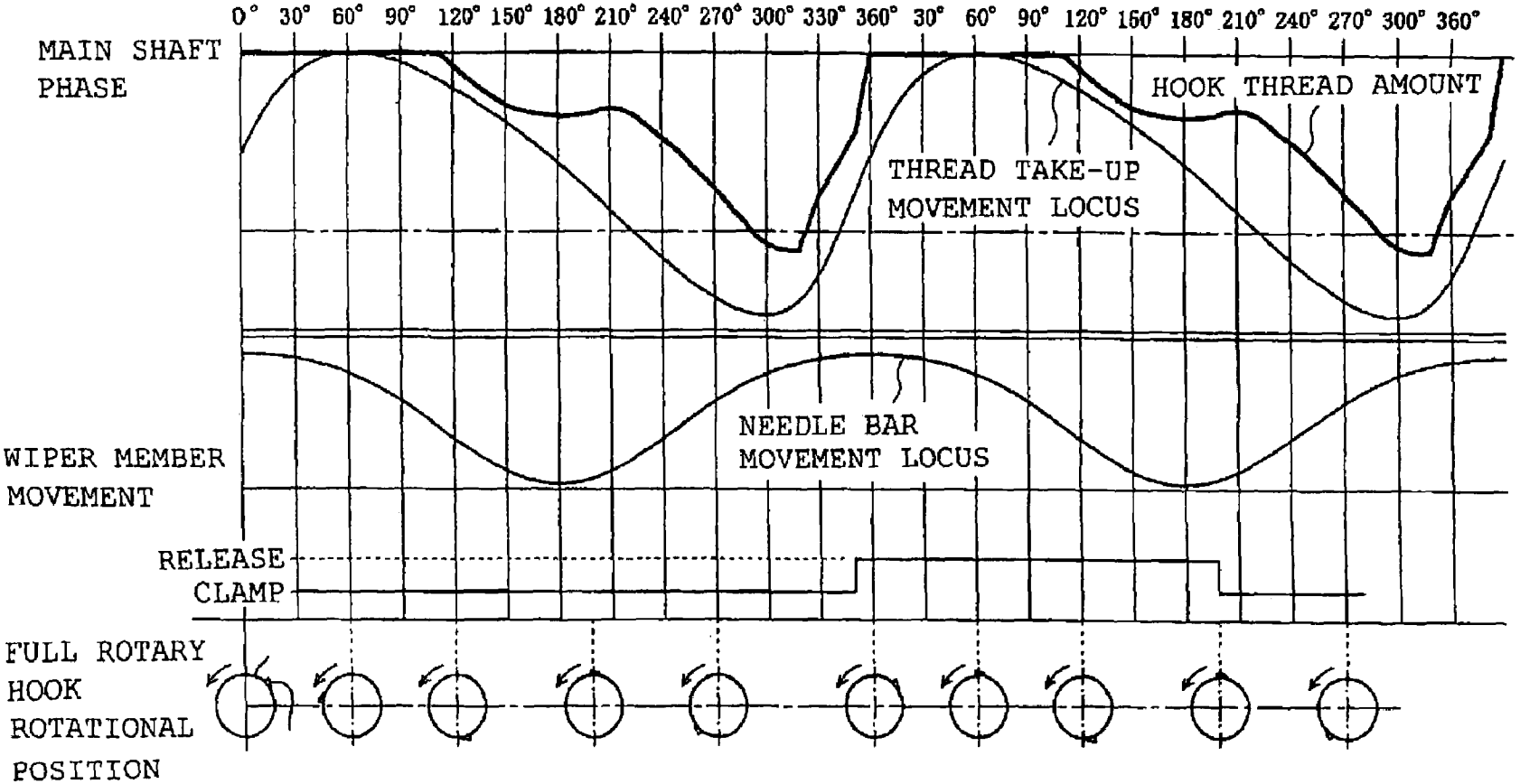
FIG. 42 is a time chart indicating each operation of the sewing machine.

Next, stitch formation by cooperation of the vertical movement of the sewing needle 105 and a full rotary hook 159 is described with reference to a time chart indicated in FIG. 42. In FIG. 42, a movement locus of the thread take-up and the needle bar, the movement of the wiper member 121, the position of a tip 159*a* of the full rotary hook 159 and a curve indicating a hook thread amount are associated with a rotary phase of the main shaft. The full rotary hook 159 includes an inner hook accommodating a bobbin therein, an outer hook rotating the exterior of the inner hook and the tip 159*a* forming a needle thread loop by capturing the needle thread T1 and provided on the outer hook.

Supposing that the main shaft assumes a 0° rotary phase when the needle bar 108 is in the uppermost position, after needle the thread T1 is cut by a needle cutting unit not shown after completion of a sewing operation, the main shaft stops at a rotary phase of approximately 30°. When the subsequent sewing operation is started from the above position and the main shaft is rotated, the needle thread T1 extending from the eye of the sewing needle 105 is caught by the tip 159*a*. Thereafter, the main shaft is further rotated so as to continuously rotate the tip 159*a* of the outer hook, and the size of the needle thread loop (hook thread amount) is increased while moving around the outer peripheral surface of the inner hook. Thereafter, when the rotary phase of the main shaft is approximately 320°, the size of the needle thread loop is maximized. Immediately thereafter, the needle thread loop is completely passed around the outer peripheral surface of the inner hook allowing the needle thread loop to be pulled up by the thread take-up. Then, the thread take-up is elevated until the rotary phase of the main shaft reaches 60° (360°+60°), and the needle thread loop passed around the inner hook is pulled up to form the first stitch. Subsequently, when the rotary phase of the main shaft reaches 200°

(360°+200°), the needle thread T1 extending from the eye of the sewing needle 105 is caught by the tip 159 in a similar manner.

The release timing in which the wiper member 121 is moved from the clamp position to the release position will be described hereinafter.

As shown in FIG. 42, the release timing is defined at a main shaft rotary phase of approximately 345°. At this point, the thread amount of the needle thread T1 pulled up by the thread take-up in the subsequent main shaft rotation substantially equals the thread amount of the needle thread loop. Thus, a stitch is reliably formed without the thread end of the needle thread T1 being completely pulled under the workpiece cloth W1 even if the clamping of the needle thread T1 is released.

In case the release timing of the wiper member 121 is later than approximately 345°, the thread amount of the needle thread T1 pulled up by the thread take-up in the subsequent main shaft rotation exceeds the thread amount of the needle thread loop. Hence, the bobbin thread is pulled above the workpiece cloth W1 by the needle thread T1, forming an unsuccessful stitch and impairing the sewing quality. Whereas in case the release timing is earlier than approximately 345°, the thread end of the needle thread T1 is completely pulled under the workpiece cloth W1 while the needle thread loop, increasing in size, is being passed around the outer peripheral surface of the inner hook. Hence, a stitch cannot be formed.

Next, a clamping timing in which the wiper member 121 is moved from the release position to the clamp position is described hereinafter.

There are cases where the thread end of the needle thread T1 is not fully removed from between the thread clamp surface 157 and the magnet piece 156 even if the clamping by the thread clamp surface 157 and the magnet piece 156 clamping the thread end of the needle thread T1 therebetween is released. Therefore, as shown in FIG. 42, the wiper member 121 is set to maintain the release position until the rotary phase of the main shaft reaches approximately 200° (360°+200°). At this point, since the thread end of the needle thread T1 is further pulled under the workpiece cloth W1 by the second stitch of needle thread T1 being caught by the tip 159*a*, the thread end of the needle thread T1 is fully pulled out from between thread clamp surface 157 and the magnet piece 156. Thus, the thread end of the needle thread T1 of the first stitch does not remain on the upper surface of the workpiece cloth W1.

Thus, the wiper device 117 according to the present invention is provided with a wiper member 121 for performing the thread wiping operation. The thread end clamp member 116 and a thread end clamp portion 130 are formed respectively on the embroidery presser foot 114 and the wiper member 121. Since thread end of the needle thread T1 cut by the thread cutting unit after the sewing operation is clamped by cooperation of the thread clamp member 116 and the thread clamp portion 130, the initial stitch of the subsequent sewing sequence is formed properly, improving the sewing quality. Furthermore, the simple construction of the wiper device renders the size and manufacturing cost reduction.

Also, the clamping of the needle thread T1 clamped by cooperation of the thread end clamp member 116 and the thread end clamp portion 130 is released when the wiper member 121 is positioned in the release position by being swung by the predetermined small distance towards the operating posit ion from the clamp position. Thus, the clamped needle thread T1 can be released reliably.

Furthermore, the thread end clamp member 116 and the thread end clamp portion 130 are constructed by a magnet piece 156 having magnetic force and a magnetic material respectively. Thus, the thread end clamp portion 130 is attracted by the magnetic force of the magnet piece 156. Hence, the needle thread-end T1 can be clamped firmly. Yet, furthermore the thread end clamp portion 130 is provided with the thread clamp surface 157 abutting the thread end clamp member 116; and the protrusion 158 provided near the thread clamp surface 157 and guiding the thread end of the needle thread T1. Hence, the thread end of the wiped needle thread T1 does not fall off from the thread clamp surface 157, thereby stabilizing the position of the thread end of the needle thread T1.

Figure 43:
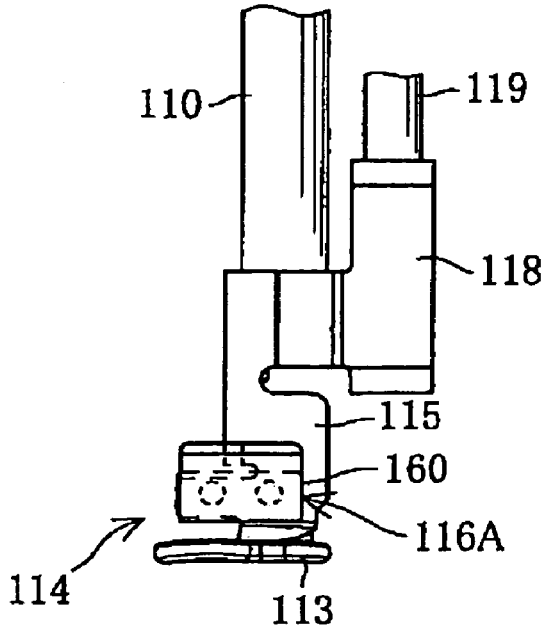
FIG. 43 is an exploded front view of a main part of the cloth presser according to a third illustrative aspect of the present disclosure.
Figure 44:
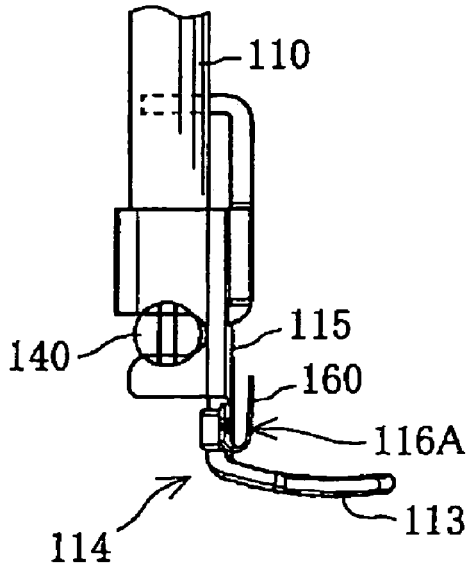
FIG. 44 is an exploded left side view of a main part of a cloth presser.
Figure 45:
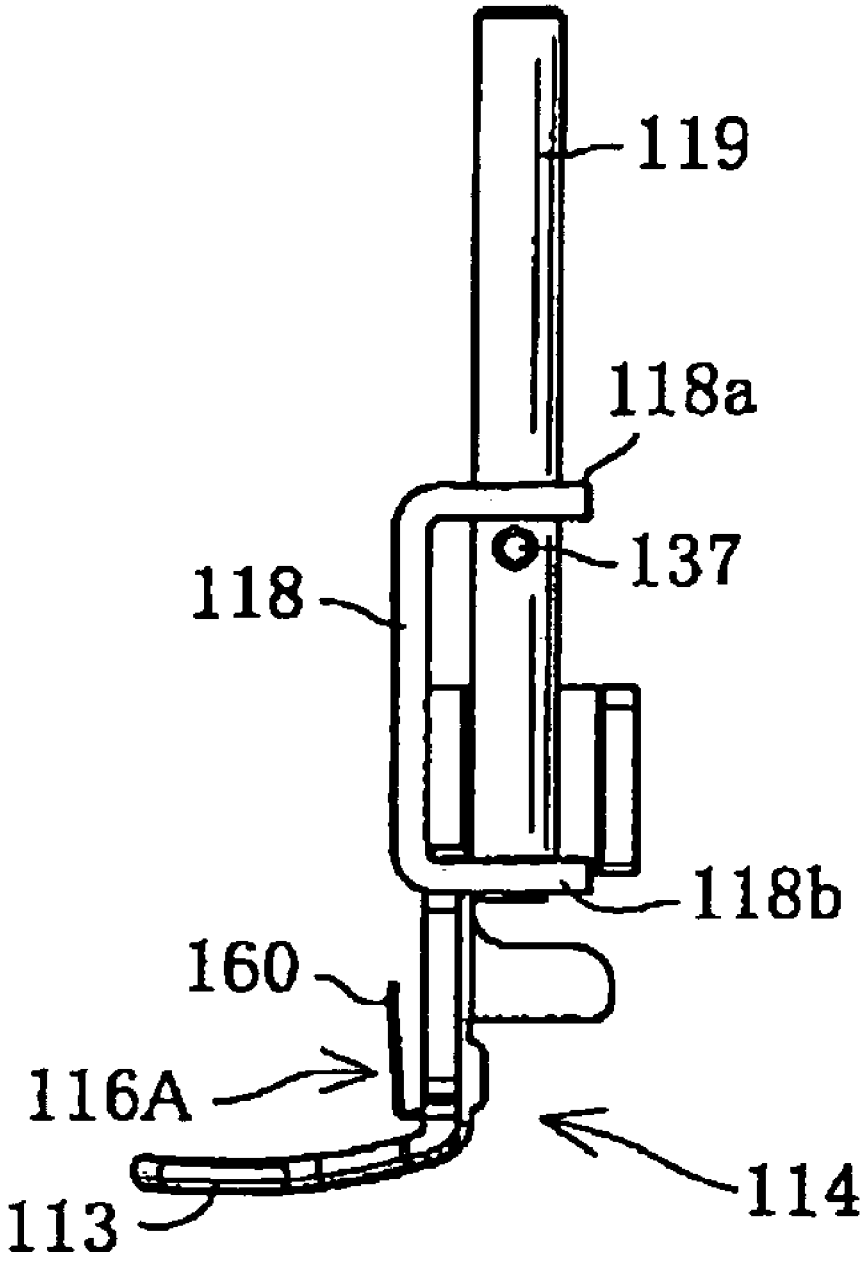
FIG. 45 is an exploded right side view of the main part of the cloth presser.

Next, a third embodiment partially modifying the above described second embodiment will be described with reference to FIGS. 43 to 45.

In the above described embodiment, the thread end clamp member 116 formed on the cloth presser main body 115 of the embroidery presser foot 114 side is constructed by a magnet piece 156. However, as shown in FIGS. 43 to 45, the thread end clamp member 116 may be alternatively constructed by an elastic member 160 having elasticity. The elastic member 160 is constructed by a plate spring. The plate spring is in an elongated oblong form in front view and is shaped so as to forwardly protrude with respect to the cloth presser main body 115 of the embroidery presser foot 114 as to a form a letter J in side view. The plate spring is fixed to the cloth presser main body 115 by a rivet. In this case, since the thread end clamp member 116A is constructed by the elastic member 160 having elasticity, the strength of clamping the thread end of the needle thread T1 is increased, thereby enabling the clamping of articles varying in thread thickness and material. Furthermore, by constructing the elastic member 160 by a plate spring, simple and low cost manufacture is attained.

The elastic member 160 is not limited to the plate spring but may be replaced by rubber, sponge, felt urethane foam, or the like.

The magnet piece 156 or the elastic member 160 provided on the embroidery presser foot 114 side in the above embodiment can alternatively be provided on the wiper member 121 side or on both sides.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

I claim:

1. A wiper device for a sewing machine mounted on an embroidery presser foot having a cloth presser through which a sewing needle is penetratable, the wiper device comprising:

a wiper member that wipes a needle thread end extending from an eye of the sewing needle so as to pull a needle thread-end above a workpiece cloth after the needle thread is cut by a thread cutting unit, wherein the needle thread-end is retained by cooperation of the cloth presser and the wiper member.

2. The wiper device according to claim 1, wherein the wiper member comprises a thread engagement portion, the needle thread-end being retained by being clamped between the thread engagement portion and the cloth presser.

3. The wiper device according to claim 2, wherein the wiper member is supported swingably between an operating position for performing a thread wiping operation and an non-operating stand-by position by the embroidery presser foot, and when the wiper member returns from the operating position to the stand-by position, the needle thread-end is retained by being clamped between the cloth presser and the thread engagement portion.

4. The wiper device according to claim 2, wherein at least either one of the cloth presser or the thread engagement portion is provided with a frictional-resistance applying member for applying frictional resistance on the needle thread-end.

5. The wiper device according to claim 4, wherein the frictional-resistance applying member is fixed to an underside of the thread engagement portion, and the needle thread-end is retained by being clamped between the frictional-resistance applying member and an upper surface of the cloth presser.

6. The wiper device according to claim 4, wherein the frictional-resistance applying member comprises a pile member, the pile member being a base cloth with a short fiber implanted thereon.

7. The wiper device according to claim 2, wherein a shape of the cloth presser and the thread engagement portion in plan view are substantially same.

8. The wiper device according to claim 2, wherein the cloth presser and the thread engagement portion have penetration holes through which a sewing needle is penetratable, respectively.

9. A wiper device for a sewing machine mounted on an embroidery presser foot having a cloth presser through which a sewing needle is penetratable, the wiper device comprising:

a wiper member wiping a needle thread extending from an eye of the sewing needle so as to pull a needle thread-end above a workpiece cloth after cutting the needle thread with a thread cutting unit;

a thread end clamp member formed on the cloth presser;

a thread end clamp portion formed on the wiper member;

wherein the needle thread-end is clampable by cooperation of the thread end clamp member and the thread end clamp portion.

10. The wiper device according to claim 9, wherein the wiper member is supported swingably between an operating position for performing a thread wiping operation and a clamp position for clamping the upper thread-end by cooperation of the thread end clamp member and the thread end clamp portion by an embroidery presser foot.

11. The wiper device according to claim 10, wherein when the wiper member is swung to a release position which is distanced by a predetermined distance toward the operating position from the clamp position, the needle thread-end clamped in cooperation by the thread end clamp member and the thread end clamp portion is released.

12. The wiper device according to claim 11, further comprising a link arm integrally formed on the wiper member and a drive pin driving the wiper member, wherein the link arm has a link slit to which the drive pin is slidably inserted, the link slit comprising a linear portion and a circumferential portion, and the linear portion is inclined with respect to a vertical direction so as to extend rearwardly upward.

13. The wiper device according to claim 9, wherein the thread end clamp member comprises an elastic member having elastic force.

14. The wiper device according to claim 13, wherein the elastic member comprises a plate spring.

15. The wiper device according to claim 9, wherein the thread end clamp member comprises a magnet piece having magnetic force, and the thread end clamp portion comprises a magnetic material.

16. The wiper device according to claim 9, wherein the thread end clamp portion further comprises a thread clamp surface abutting the thread end clamp member and a protrusion provided near the thread clamp surface and guiding the needle thread-end.

17. A wiper device for a sewing machine mounted on an embroidery presser foot having a cloth presser through which a sewing needle is penetratable, the wiper device comprising:

a wiper member wiping a needle thread extending from an eye of the sewing needle so as to pull a needle thread-end above a workpiece cloth after the needle thread is cut by a thread cutting unit, wherein the wiper member comprising a thread engagement portion that clamps the needle thread-end in cooperation with the cloth presser, and a frictional force applying member, provided on either one of the cloth presser or the thread engagement portion for applying frictional force on the needle thread in a retained state.

* * * * *